US011534697B2

(12) United States Patent
Lopez

(10) Patent No.: US 11,534,697 B2
(45) Date of Patent: Dec. 27, 2022

(54) TOY VEHICLE PLAYSET WITH INTERACTIVE FEATURES

(71) Applicant: Mattel, Inc., El Segundo, CA (US)

(72) Inventor: Gabriel Lopez, Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 50 days.

(21) Appl. No.: 17/167,179

(22) Filed: Feb. 4, 2021

(65) Prior Publication Data

US 2021/0245069 A1 Aug. 12, 2021

Related U.S. Application Data

(60) Provisional application No. 62/972,153, filed on Feb. 10, 2020.

(51) Int. Cl.
*A63H 18/02* (2006.01)
*A63H 18/06* (2006.01)

(52) U.S. Cl.
CPC ..... *A63H 18/025* (2013.01); *A63H 18/026* (2013.01); *A63H 18/06* (2013.01)

(58) Field of Classification Search
CPC ..... A63H 18/00; A63H 18/02; A63H 18/06; A63H 18/16; A63H 18/026; A63H 18/025; A63F 9/14; A63F 9/0247
See application file for complete search history.

(56) References Cited

U.S. PATENT DOCUMENTS 1,472,733 A 10/1923 Maxwell
1,924,261 A * 8/1933 Thompson ..... A63F 9/0247 89/1.51
2,672,709 A 3/1954 Ernst
3,593,454 A 7/1971 Einfalt
3,654,728 A 4/1972 Beny et al.
3,789,538 A * 2/1974 Spengler ..... A63H 17/44 446/423
3,908,989 A * 9/1975 Meyer ..... A63F 9/00 446/444
4,091,561 A * 5/1978 Kimura ..... A63H 18/04 238/10 C (Continued)

FOREIGN PATENT DOCUMENTS

DE 3703045 A1 * 8/1988

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

An improved toy vehicle playset contains a tower and multiple track portions coupled to the tower that provide a path for toy vehicles to descend from the top of the tower. The tower may include an elevator mechanism for transporting toy vehicles up the tower and an interactive feature that is configured to interact with descending toy vehicles along the track portions. The descent of the toy vehicles may trigger the interactive feature to also descend from the top of the tower, where the descending interactive feature may attempt to impede or stop the descending toy vehicles along the track portions. In some embodiments, the one or more towers may further include platforms configured to store and retain a plurality of toy vehicles, mechanisms that trigger one or more toy vehicles to be launched from the platforms, and mechanisms for diverting toy vehicles onto the platforms.

20 Claims, 25 Drawing Sheets

(56) References Cited

U.S. PATENT DOCUMENTS 4,109,410 A * 8/1978 Saitoh ..... A63H 18/04 446/178
4,128,964 A 12/1978 Ogasawara
4,237,648 A 12/1980 Moe et al.
4,254,576 A * 3/1981 Matsumoto ..... A63H 18/00 446/444
4,291,488 A * 9/1981 Orenstein ..... A63H 18/025 446/314
4,662,855 A * 5/1987 Morrison ..... A63H 3/48 446/353
4,708,685 A 11/1987 Udagawa
5,683,298 A * 11/1997 Jackson ..... A63H 18/02 463/58
6,358,112 B1 3/2002 Lambert et al.
6,508,179 B2 1/2003 Annis et al.
6,663,464 B2 12/2003 Payne et al.
7,537,509 B2 5/2009 Payne et al.
7,614,931 B2 * 11/2009 Nuttall ..... A63H 18/026 446/423
7,892,068 B2 * 2/2011 Nuttall ..... A63H 18/026 446/478
8,066,545 B2 * 11/2011 Jourdian ..... A63H 18/02 446/444
8,317,565 B2 11/2012 Shallah
8,591,284 B2 11/2013 Dubois
8,628,373 B2 1/2014 Payne
8,870,623 B2 10/2014 Ferreyra et al.
8,876,573 B2 11/2014 O'Connor et al.
9,504,926 B2 11/2016 O'Connor et al.
9,707,489 B2 7/2017 Nuttall et al.
9,925,471 B2 3/2018 Flores
10,500,478 B2 * 12/2019 Kurita ..... A63F 9/28
2006/0084361 A1 4/2006 Favorito et al.
2007/0197127 A1 8/2007 Ostendorff et al.
2008/0113585 A1 * 5/2008 Payne ..... A63H 18/02 446/444
2008/0268743 A1 * 10/2008 O'Connor ..... A63H 18/06 446/429
2010/0273392 A1 10/2010 Nuttall
2010/0273394 A1 * 10/2010 O'Connor ..... A63H 18/02 446/429
2011/0294396 A1 12/2011 O'Connor et al.
2012/0061484 A1 * 3/2012 Payne ..... A63H 18/10 238/10 A
2012/0178336 A1 * 7/2012 Nuttall ..... A63H 23/005 446/153
2014/0091154 A1 * 4/2014 Nuttall ..... A63H 18/02 238/10 A
2014/0194035 A1 7/2014 Jourdian et al.
2015/0087201 A1 3/2015 Grafton et al.
2015/0097043 A1 * 4/2015 Lau ..... A63H 18/16 238/10 F
2016/0206966 A1 7/2016 Nuttal et al.
2016/0310857 A1 * 10/2016 Effler ..... A63H 18/02
2017/0106303 A1 4/2017 O'Connor et al.

* cited by examiner

TOY VEHICLE PLAYSET WITH INTERACTIVE FEATURES

CROSS-REFERENCE TO RELATED APPLICATIONS

This application claims priority under 35 U.S.C. 119(e) to U.S. Provisional Patent Application Ser. No. 62/972,153, entitled "Toy Vehicle Playset With Interactive Features," filed Feb. 10, 2020, the disclosure of which is incorporated herein by reference in its entirety for all purposes.

FIELD OF THE INVENTION

The present invention relates to a toy vehicle playset, and in particular, a toy vehicle playset with an interactive feature or object. More specifically, the interactive feature or object is movable with respect to the toy vehicles and the playset itself, and is capable of interacting with toy vehicles traveling along the toy vehicle playset and/or portions of the toy vehicle playset itself in order to provide unique play patterns with the toy vehicle playset.

BACKGROUND OF THE INVENTION

Various toy vehicle playsets are known, where many of the known toy vehicle playsets are used to simulate raceways, cityscapes, and/or other backdrops. In some instances, the toy vehicle playsets resemble a tower having tracks that form pathways that facilitate the descent of toy vehicles from the top of the tower to the bottom of the tower. These playsets, however, are limited in their play patterns because they often lack interactive features that dictate how the toy vehicles descend from the top of the tower, and that determine whether or not the toy vehicle fully descend from the top of the tower (i.e., whether or not they are impeded or knocked off of the pathway defined by the track). In addition, these known toy vehicle tower playsets often do not include any storage for the toy vehicles when they are not in use. Thus, users of the toy vehicle tower playsets are forced to find other locations in which to store their toy vehicles when they are not in use.

Therefore, there is a need for a toy vehicle playset that includes a tower from which toy vehicles are capable of descending that also includes at least one interactive feature or object that dictates how and whether a toy vehicle successfully descends the tower via the track sections of toy vehicle tower playset. Furthermore, there is a need for a toy vehicle playset with storage locations disposed along the tower of the toy vehicle playset, where the storage locations are configured to store the toy vehicles when not in use.

SUMMARY OF THE INVENTION

The present invention disclosed herein is a toy vehicle playset that contains one or more towers, multiple track sections that create a pathway for toy vehicles to descend from the top of the one or more towers to the base of the toy vehicle playset, and an interactive object that interacts with the toy vehicles as they descend from the top of the one or more towers. The embodiment of the toy vehicle playset described herein provides a unique play pattern for toy vehicles. The toy vehicle playset may include an elevator mechanism operatively coupled to the one or more towers for transporting toy vehicles up to the top of the one or more towers. The interactive object may also be operatively coupled to the one or more towers, and may be configured to interact with the descending toy vehicles along the track sections. More specifically, the descent of the toy vehicles may trigger the interactive object to also descend from the top of the one or more towers, where the descending interactive object may attempt to impede or stop a descending toy vehicle along one of the track portions. In operation, the toy vehicle playset enables a play pattern where the toy vehicles descend along multiple track sections to try and escape being caught and impacted by the interactive object. In additional embodiments, the one or more towers may further include platforms configured to store and retain a plurality of toy vehicles, mechanisms that trigger a toy vehicle to be launched from the platforms, and mechanisms for diverting toy vehicles onto the platforms.

In one embodiment, the present invention disclosed herein is a toy vehicle playset that includes a base, a tower, at least one track, and an interactive object. The tower may extend upwardly from the base. The at least one track may be disposed about the tower, and may be configured to enable a toy vehicle to descend the tower along the track. The interactive object may be movably coupled to the tower such that the interactive object may be configured to linearly ascend and descend the tower. When the interactive object descends the tower simultaneous to the toy vehicle descending the tower via the track, the interactive object may be configured to attempt to impact the toy vehicle traveling along the track.

In at least some instances, the at least one track helically extends around the tower. In some further instances, the at least one track may include at least one front track disposed proximate to a front side of the tower. The front side of the tower may also include a linear rack. Additionally, in some instances, interactive object may be movably coupled to the front side of the tower, and may include a set of gears that are configured to intermesh with the linear rack of the tower. In some even further instances, when the toy vehicle begins to descend from a top end of the tower along the at least one track simultaneous to the interactive object linearly descending from the top end of the tower, the set of gears may cause the interactive object to linearly descend with a speed such that the interactive object reaches the at least one front track at approximately a time the toy vehicle travels along the at least one front track (i.e., interactive object and the toy vehicle reach the at least one front track at the same time). The interactive object may further include at least one movable member that is configured to perform a repeated movement as the interactive object linearly descends the tower.

In another embodiment, the present invention disclosed herein is a toy vehicle playset that includes a base, a tower, a series of track sections, and an interactive objection. The tower may extend upwardly from the base. The series of track section may collectively define a path for a toy vehicle to descend the tower. The interactive object may be movably coupled to the tower such that the interactive object is configured to linearly ascend and descend the tower. When the interactive object travels linearly along the tower, the interactive object may intersect at least one track section of the series of track sections.

In some instances, the at least one track section may further includes a rotatable track portion. When the interactive object travels linearly along the tower, the interactive object may cause the rotatable track portion to rotate as the interactive object passes through the at least one track section.

In some further instances, the toy vehicle playset may further include a movable platform and a crank mechanism.

The movable platform may be movably coupled to the tower such that the movable platform is configured to linearly ascend and descend the tower. The crank mechanism may be operatively coupled to the movable platform where rotation of the crank mechanism causes the movable platform to linearly ascend the tower. In some additional instances, the interactive object may further include a lockout mechanism that is repositionable between a first position and a second position. When the lockout mechanism is in the first position, the lockout mechanism may couple the interactive object to the movable platform. When the lockout mechanism is in the second position, the interactive object may be uncoupled from the movable platform. In some even further instances, when the lockout mechanism is in the first position and when the movable platform and the interactive object are disposed proximate to a bottom end of the tower, rotation of the crank mechanism may cause the movable platform and the interactive object to linearly ascend the tower toward a top end of the tower. When the lockout mechanism is in the second position and when the movable platform and the interactive object are disposed proximate to the bottom end of the tower, rotation of the crank mechanism may cause the movable platform to linearly ascend the tower toward the top end of the tower while the interactive object remains disposed proximate to the bottom end of the tower.

In yet another embodiment, the present invention disclosed herein is a toy vehicle playset that includes a base, a tower, at least one track, and an interactive objection. The tower may extend upwardly from the base, and may include a top end and a bottom end. The at least one track may be disposed about the tower, and may include an actuator operatively coupled to a portion of the track. The at least one track may be configured to enable a toy vehicle to descend the tower along the track. The toy vehicle may actuate the actuator when traveling along the portion of the track. The interactive object may be movably coupled to the tower such that the interactive object is configured to linearly ascend and descend the tower. Actuation of the actuator by the toy vehicle traveling along the at least one track when the interactive object is positioned proximate the top end of the tower may release the interactive object to descend linearly along the tower.

In some instances, the actuator may include a trigger member and a contact member operatively coupled to the trigger member. The trigger member may extend through the portion of the track and may be configured to rotate about a horizontal axis with respect to the portion of the track. Rotation of the trigger member may cause the contact member to rotate about a vertical axis from a first position to a second position. In some further instances, the interactive object may be movably coupled to the tower via a bracket. In some even further instances, when the interactive object is positioned proximate the top end of the tower and the actuator is unactuated, the contact member may be in the first position where the contact member may be in abutment with the bracket, which may retain the interactive object proximate to the top end of the tower. Additionally, when the toy vehicle travels along the portion of the track and actuates the actuator, the toy vehicle may impact and rotate the trigger member about the horizontal axis. Moreover, in some instances, rotation of the contact member about the vertical axis from the first position to the second position may cause the contact member to become spaced from the bracket of the interactive object, which may release the interactive object to linearly descend along the tower.

BRIEF DESCRIPTION OF THE DRAWINGS

Like reference numerals have been used to identify like elements throughout this disclosure.

DETAILED DESCRIPTION OF THE INVENTION

Figure 1A:
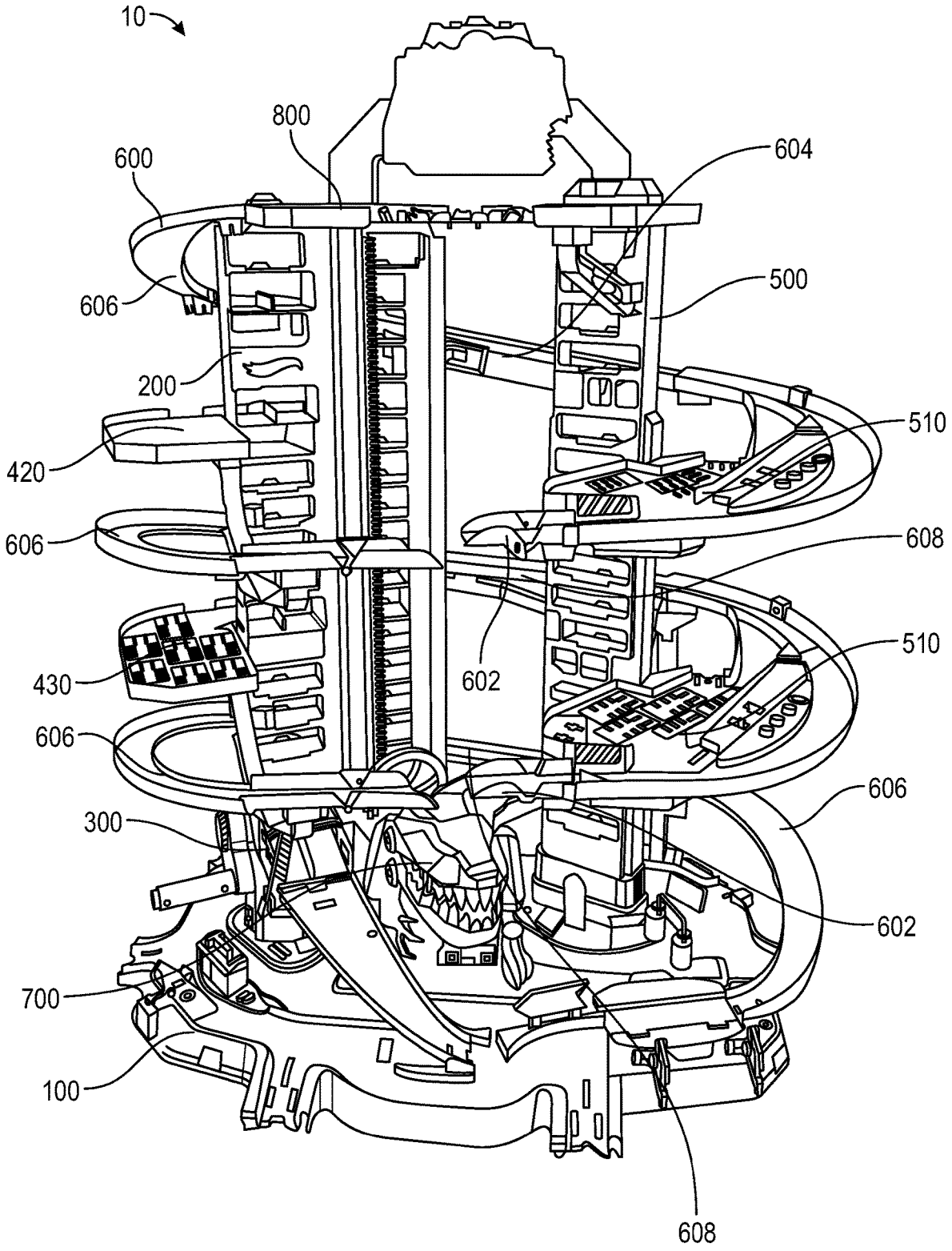
FIG. 1A illustrates a front view of an embodiment of a toy vehicle playset that includes a tower from which toy vehicles descend and at least one interactive feature or object in accordance with the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

The present invention disclosed herein is a toy vehicle playset that is equipped with one or more towers and track portions coupled to the one or more towers. The plurality of track portions may provide a path for a toy vehicle to travel from a location proximate to the top end of the tower to the base of the toy vehicle playset. In some embodiments, the track portions may encircle the one or more towers multiple times such that a toy vehicle traveling along the track portions circles around the one or more towers multiple times as they descend from the top end of the one or more towers to the base of the playset. The one or more towers may be further equipped with an elevator mechanism for transporting toy vehicles from the base of the toy vehicle playset to a location proximate to the top of the one or more towers so that the toy vehicles may descend from the location proximate to the top end of the tower via the track portions. Furthermore, the one or more towers may also be equipped with an interactive feature or object that is configured to interact with the toy vehicles as they descend from the top of the one or more towers along the track portions. In some embodiments, the interactive object may have the appearance of a dinosaur with chomping jaws, but other appearances of the interactive object are not beyond the scope of this invention. As the toy vehicles begin descending from the top of the one or more towers, the toy vehicles may trigger the interactive object to also descend from the top of the one or more towers, where the interactive object may attempt to impede or stop a toy vehicle from fully descending to the base of the toy vehicle playset via the track portions. In some embodiments, the one or more towers may further include platforms configured to store and retain a plurality of toy vehicles. Some of the platforms may also contain mechanisms that trigger a toy vehicle to be launched from the platform onto one of the track portions so that the launched toy vehicle may descend the one or more towers along the track portions. Certain track portions may also be equipped with a mechanism for diverting toy vehicles traveling along the track portions onto one or more of the platforms.

Figure 1B:
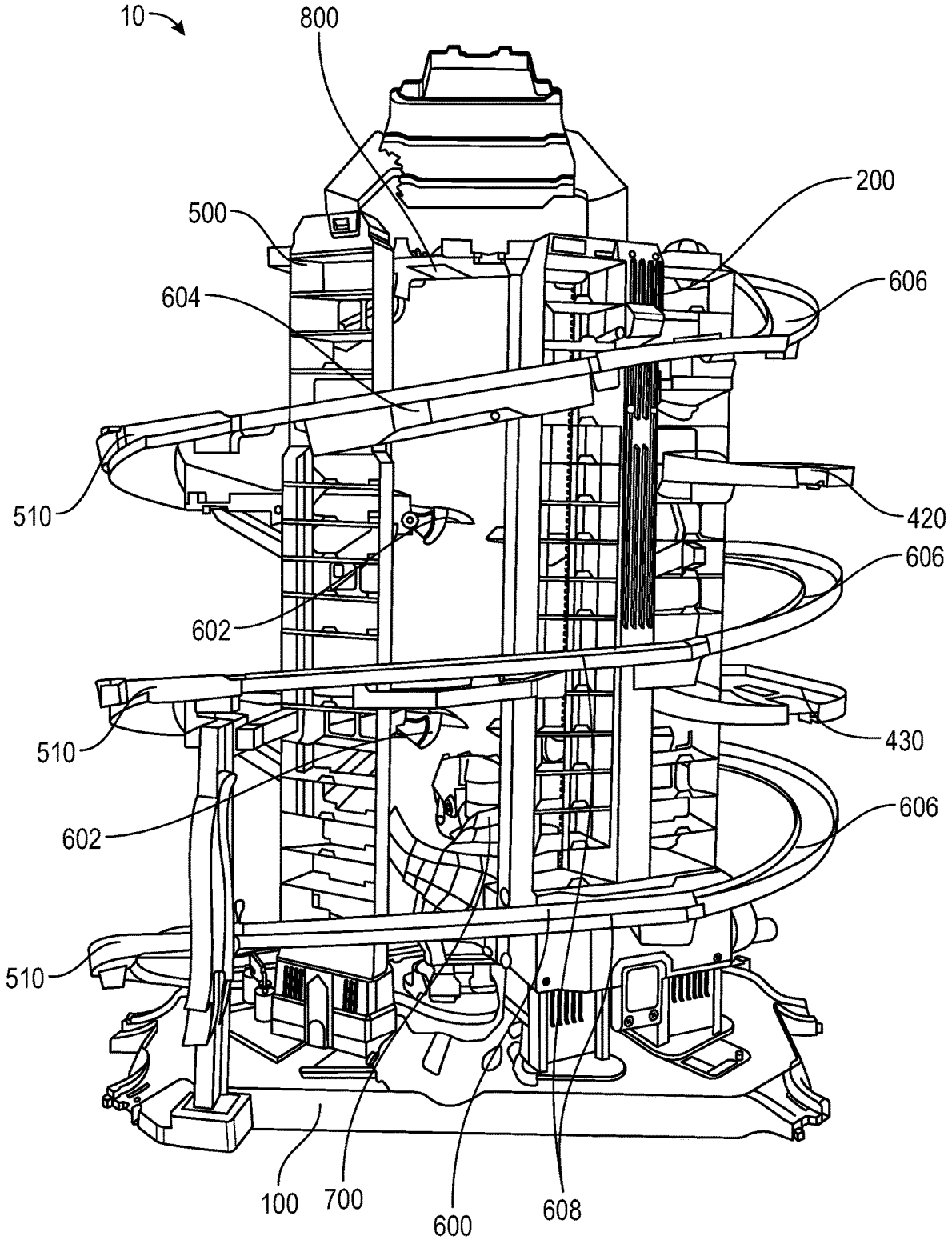
FIG. 1B illustrates a rear view of the embodiment of the toy vehicle playset illustrated in FIG. 1A.

Turning to FIGS. 1A and 1B, illustrated are front and rear views of an embodiment of a toy vehicle playset 10. As illustrated, the toy vehicle playset 10 includes a base 100 having a first tower 200 and a second tower 500 that rise or extend upwardly from the base 100. The first tower may include an elevator device 300 that is configured to raise at least one toy vehicle from the base 100 to the top end of the first tower 200. In the embodiment illustrated, the first tower 200 may also include an interactive feature or object 700 in the form of a dinosaur with chomping jaws, as further detailed below, that is configured to travel up (e.g., linearly ascend) and down (e.g., linearly descend) the first tower 200. In other embodiments, the toy vehicle playset 10 may include only a single tower.

Continuing with FIGS. 1A and 1B, a series of track sections 600 and platforms 420, 430, 510, 800 are coupled to both the first tower 200 and the second tower 500, as well as the base 100. The first tower 200, as illustrated, may include at least a first platform 420 and a second platform 430. Similarly, the second tower 500, as illustrated, may include two platforms 510. A top or uppermost platform 800 may be coupled to both the first tower 200 and the second tower 500 such that the top platform 800 spans between the first and second towers 200, 500. Each of the platforms 420, 430, 510, 800 may be configured to and capable of storing a plurality of toy vehicles. The track sections 600 include front track sections 602, an uppermost rear track section 604, curved track sections 606, and lower rear track sections 608. The track sections 600 may be interconnected with one another and the platforms 510 of the second tower 500 in order to provide a pathway along which toy vehicles may descend from the top ends of the towers 200, 500 to the base 100 (e.g., in a helical path around the towers 200, 500). In embodiments of the toy vehicle playset where only a single tower rises or extends upwardly from the base 100, the track sections 600, along with the platforms 510, may provide a pathway along which toy vehicles may descend from the top end of the single tower to the base 100 (e.g., in a helical path around the single tower). In even further embodiments, the toy vehicle playset 10 may include any number of towers about which the track sections and platforms form a pathway along which toy vehicles may descend to the base 100.

Figure 2:
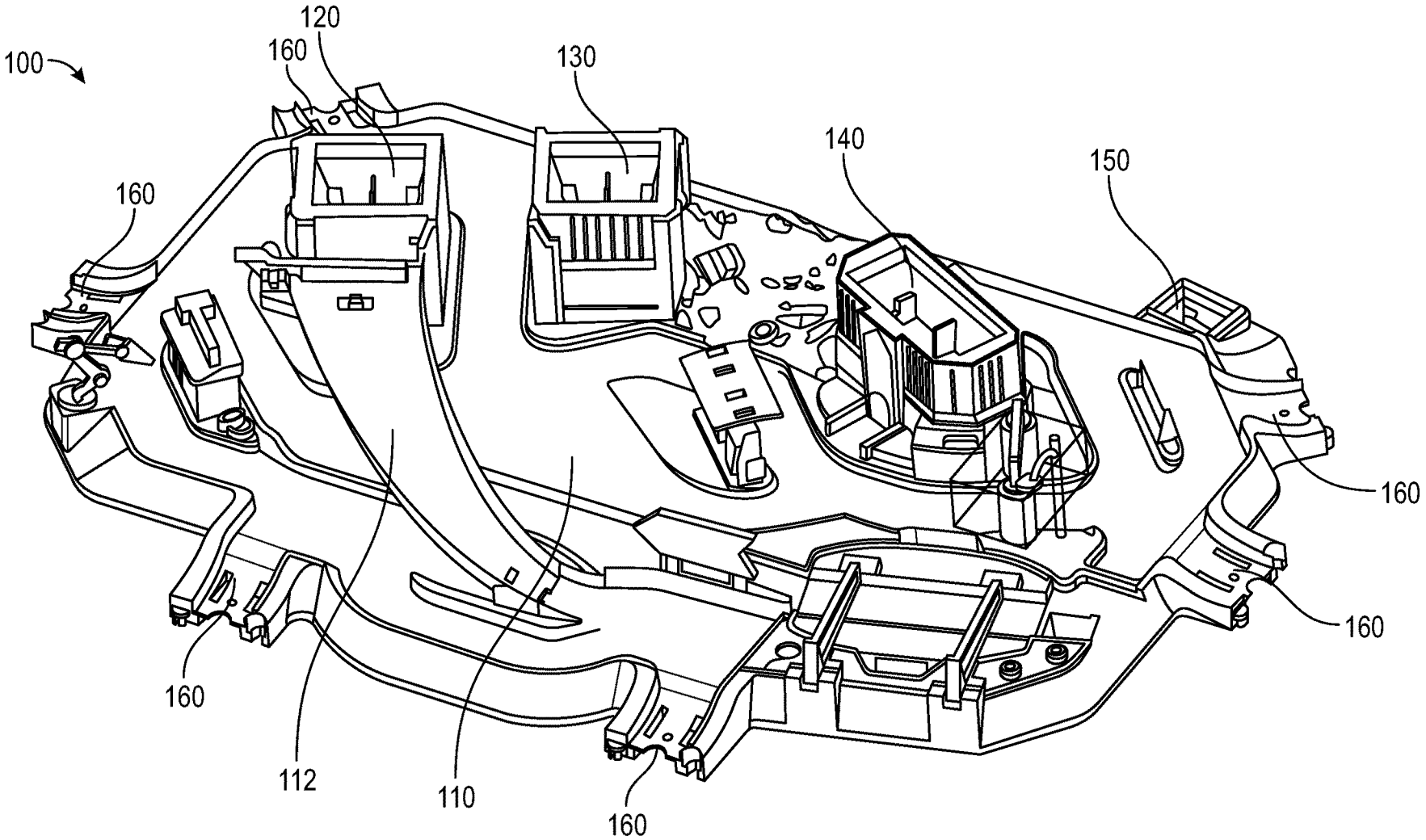
FIG. 2 illustrates a top perspective view of the base of the toy vehicle playset illustrated in FIG. 1A.

Turning to FIG. 2, illustrated is a perspective view of the base 100 of the toy vehicle playset 10. The base 100 includes a top surface 110 and an opposite bottom surface (not shown), where the bottom surface is in contact with a support surface when the base 100 is disposed on the support surface. As illustrated in FIG. 2, a ramp 112 is coupled to the top surface 110. Disposed within the top surface 110 are a first receptacle 120, a second receptacle 130, a third receptacle 140, and a fourth receptacle 150. The first, second, and third receptacles 120, 130, 140 are disposed more centrally in the top surface 110 of the base 100 than the fourth receptacle 150, which is disposed proximate to a peripheral edge of the base 100. As FIG. 2 illustrates, the ramp 112 extends upwards towards, and terminates proximate to, the first receptacle 120. The base 100 may further include a series of track connection extensions 160 disposed around the periphery of the base 100, which enable a user to connect additional tracks and/or toy vehicle playsets to the toy vehicle playset 10 illustrated in FIGS. 1A and 1B.

Figure 3A:
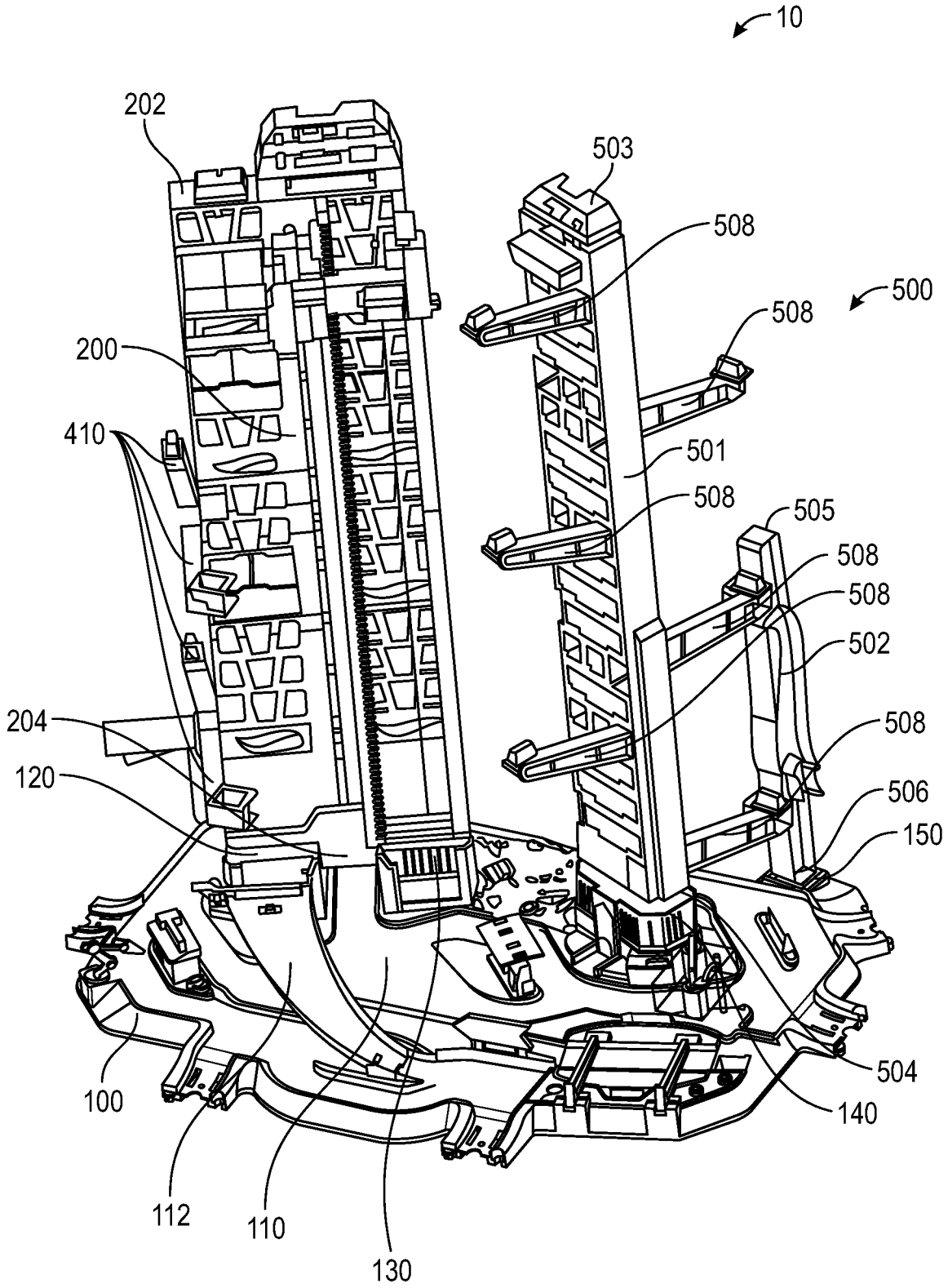
FIG. 3A illustrates a front perspective view of the first and second towers of the toy vehicle playset illustrated in FIG. 1A coupled to the base illustrated in FIG. 2.
Figure 3B:
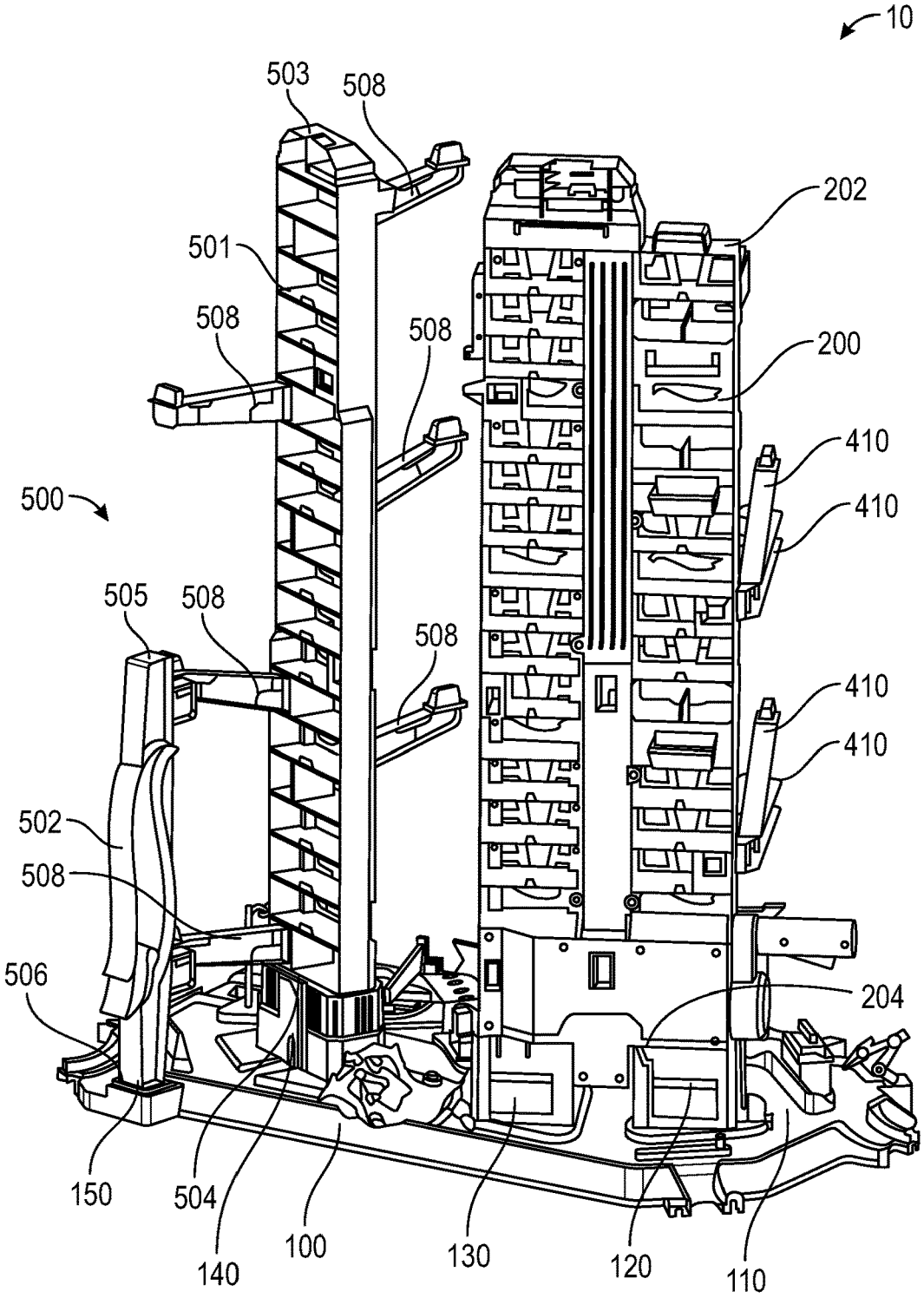
FIG. 3B illustrates a rear perspective view of the first and second towers of the toy vehicle playset illustrated in FIG. 1A coupled to the base illustrated in FIG. 2.

Turning to FIGS. 3A and 3B, illustrated are front and rear views of the first and second towers 200, 500 coupled to the base 100. As illustrated, the first tower 200 is coupled to base 100 by being disposed within the first and second receptacles 120, 130, while the second tower 500 is coupled to the base 100 by being disposed within the third and fourth receptacles 140, 150. More specifically, the first tower 200 includes a top end 202 and a bottom end 204, and at least a portion of the bottom end 204 of the first tower 200 is disposed within the first receptacle 120 and the second receptacle 130. The second tower 500, as illustrated, includes a main tower portion 501 and a secondary tower portion 502. The main tower portion 501 may include a top end 503 and an opposite bottom end 504, where the bottom end 504 may be disposed within the third receptacle 140 of the base 100. The secondary tower portion 502 of the second tower 500 may also include a top end 505 and an opposite bottom end 506, where the bottom end 506 of the secondary tower portion 502 may be disposed within the fourth receptacle 150 of the base 100. As illustrated in FIGS. 3A and 3B, the main tower portion 501 of the second tower 500 may be equal in height to the first tower 200, but may have a width that is less than the first tower 200. The secondary tower portion 502, conversely, is smaller in both height and width than the main tower portion 501 of the second tower 500. As further illustrated in FIGS. 3A and 3B, the first tower 200 includes a series of support extensions 410 that extend outwardly from the first tower 200. Similarly, both the main tower portion 501 and the secondary tower portion 502 of the second tower 500 include a series of support extensions 508. These support extensions 410, 508 are used to support both platforms 420, 430, 510, and track sections 600, 602, 604, 606, 608 above the top surface 110 of the base 100.

Figure 4A:
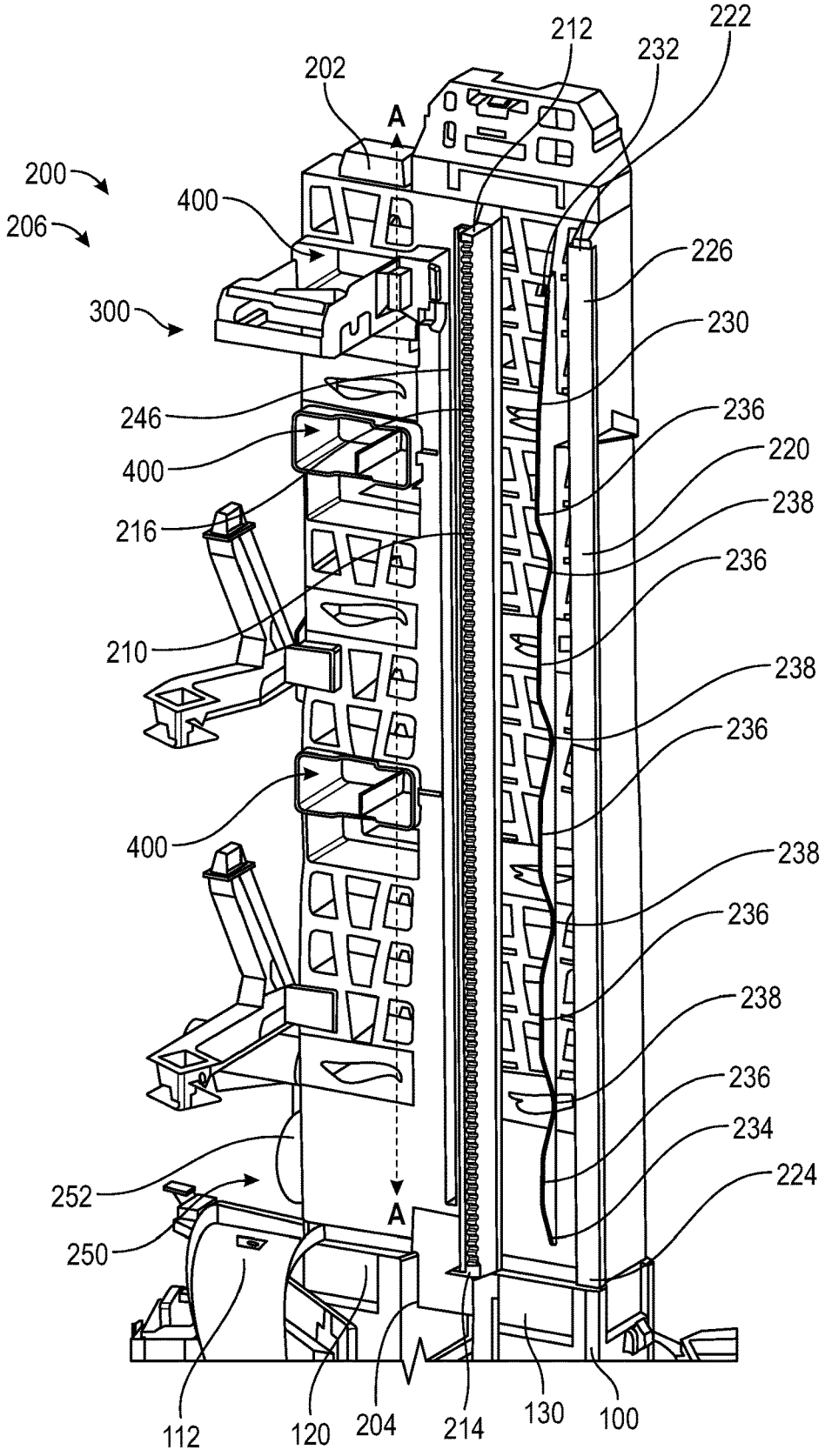
FIG. 4A illustrates a front view the first tower of the toy vehicle playset illustrated in FIG. 1A.
Figure 4B:
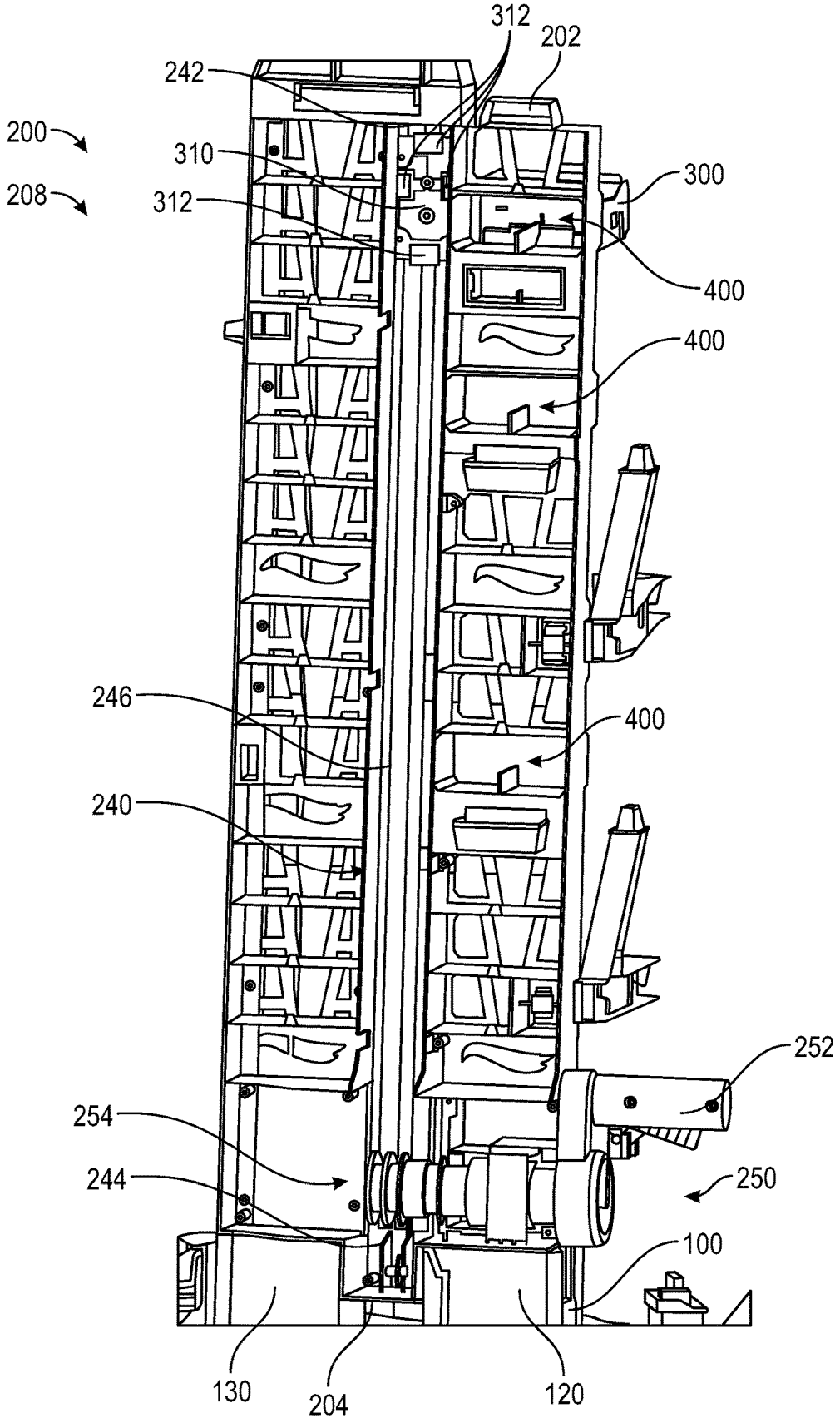
FIG. 4B illustrates a rear view of the first tower illustrated in FIG. 4A.

As illustrated in FIGS. 4A and 4B, and as previously explained, the first tower 200 includes a top end 202 and a bottom end 204 that is opposite the top end 202 and is disposed within the first and second receptacles 120, 130 of the base 100. The first tower 200 also includes a front side 206 (illustrated in FIG. 4A) and a rear side 208 (illustrated in FIG. 4B). As best illustrated in FIG. 4A, the front side 206 of the first tower 200 includes a linear rack 210, a linear guide track 220, and an interactive object track 230. The linear guide track 220 is disposed proximate to an edge of the front side 206 of the first tower 200, while the linear rack 210 is disposed substantially centrally (i.e., between the vertical edges of the first tower 200) along the first tower 200. The interactive object track 230 may be disposed between the linear guide track 220 and the linear rack 210.

Figure 7:
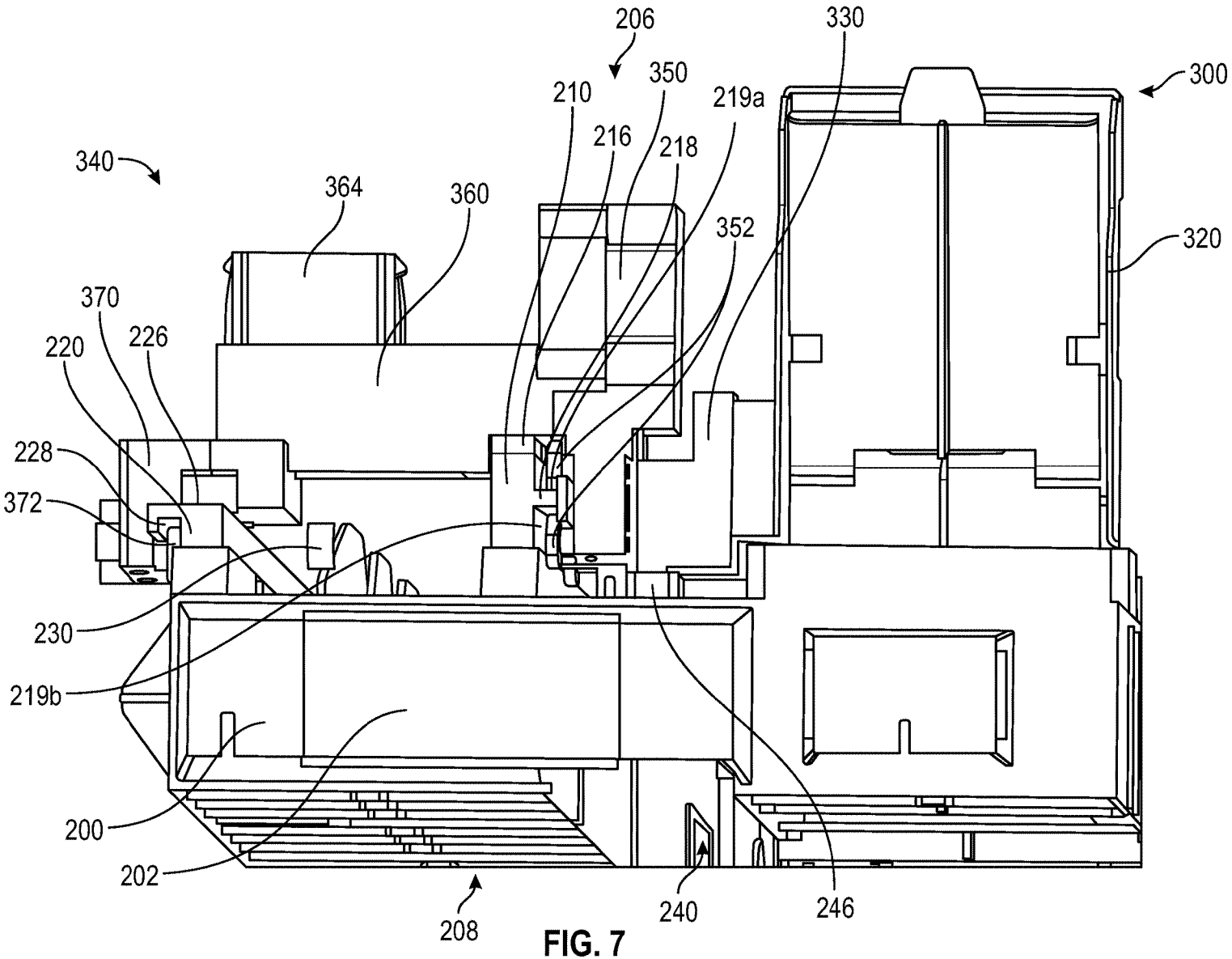
FIG. 7 illustrates a top view of the first tower illustrated in FIG. 4A, showing how the interactive object track connector illustrated in FIG. 6A is coupled to the first tower illustrated in FIG. 4A.

The linear rack 210 may include a first end 212 disposed proximate to the top end 202 of the first tower 200, and an opposite second end 214 disposed proximate to the bottom end 204 of the first tower 200. The linear rack 210 also includes a set of gear teeth 216 that span from the first end 212 to the second end 214 of the linear rack 210. As best illustrated in FIG. 7, the linear rack 210 further includes a side extension 218 that defines a first groove 219*a* and a second groove 219*b*, each of which span the length of the linear rack 210 between the first end 212 and the second end 214 of the linear rack 210.

As illustrated, the linear guide track 220 may include a first end 222 disposed proximate to the top end 202 of the first tower 200, and an opposite second end 224 disposed proximate to the bottom end 204 of the first tower 200. The linear guide track 220 also includes a smooth roller surface 226 that spans from the first end 222 to the second end 224 of the linear guide track 220. As best illustrated in FIG. 7, the linear guide track 220 further includes a groove 228 on one side of the linear guide track 220 that spans the length of the linear guide track 220 between the first end 222 and the second end 224 of the linear guide track 220.

In addition, the interactive object track 230 may include a first end 232 disposed proximate to the top end 202 of the first tower 200, and an opposite second end 234 disposed proximate to the bottom end 204 of the first tower 200. As best illustrated in FIG. 4A, the interactive object track 230 extends from the front side 206 of the first tower 200, where the interactive object track 230 includes a series of extended portions 236 and a series of recessed portions 238. As illustrated, the extended portions 236 extend farther from the front side 206 of the first tower 200 than the recessed portion 238. The extended portion 236 and the recessed portions 238 alternate with one another along the length of the interactive object track 230 between the first end 232 and the second end 234. This gives the interactive object track 230 a wave-like appearance.

Figure 8:
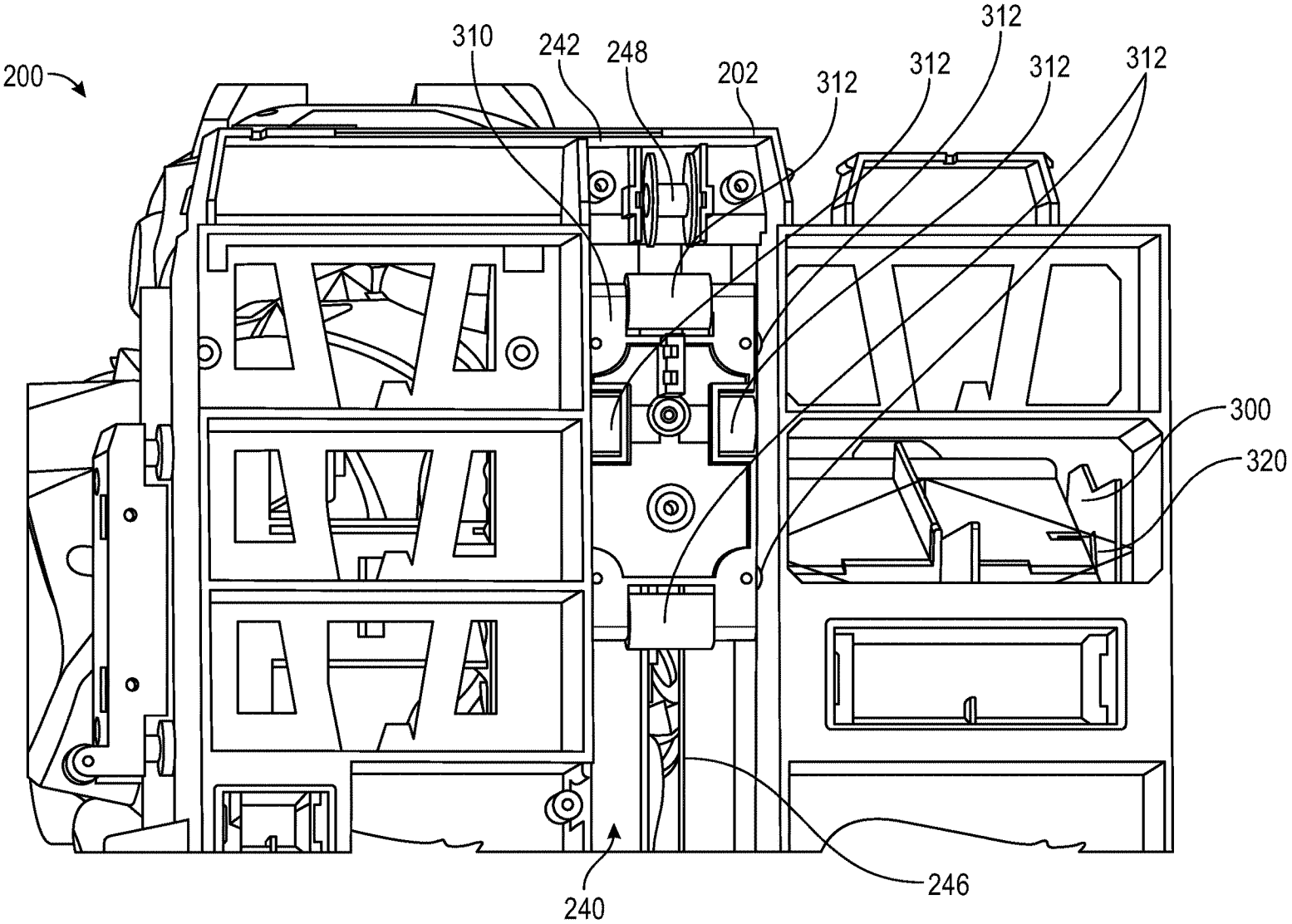
FIG. 8 illustrates a rear view of the top end of the first tower illustrated in FIG. 4A.

As best illustrated in FIG. 4B, recessed into the rear side 208 of the first tower 200 is an elevator track 240 that includes a first end 242 disposed proximate to the top end 202 of the first tower 200, and an opposite second end 244 disposed proximate to the bottom end 204 of the first tower 200. As illustrated, the elevator track 240 further includes a slot 246 that extends along the entirety of the elevator track 240, and extends through the tower 200 from the rear side 208 of the first tower 200 to the front side 206 of the first tower 200. Disposed proximate to the bottom end 204 of the first tower 200 is a crank mechanism 250. As best illustrated in FIG. 4B, the crank mechanism 250 includes a crank lever 252 that extends from the side of the first tower 200 proximate to the bottom end 204 of the first tower 200 and an internal mechanism 254 disposed within the first tower 200 and at least partially within the slot 246 proximate to the second end 244 of the elevator track 240. Further disposed within the elevator track 240, and proximate to the first end 242 of the elevator track 240, is a pulley 248, which is best illustrated in FIG. 8.

Continuing with FIGS. 4A and 4B, an elevator device 300 is disposed on the front side 206 of the first tower 200. The elevator device 300 is operatively connected to the crank mechanism 250 such that the crank mechanism 250 is configured to translate the elevator device 300 along plane A between a lowered position, where the elevator device 300 is disposed proximate to the second end 204 of the first tower and the ramp 112 of the base 100, and a raised position, where the elevator device 300 is disposed proximate to the top end 202 of the first tower of the base 100 (as illustrated in FIGS. 4A and 4B). The elevator device 300 is primarily disposed on the front side 206 of the first tower 200, where a portion of the elevator device 300, as explained in further detail below, is disposed within the elevator track 240. The elevator device 300 is configured to deliver toy vehicles from the ramp 112 to one of the passageways 400, which extend through the first tower 200 between the front side 206 and the rear side 208, in order for the toy vehicles to roll or travel from the elevator device 300 to a platform 420, 430, or a track section 600.

Figure 5A:
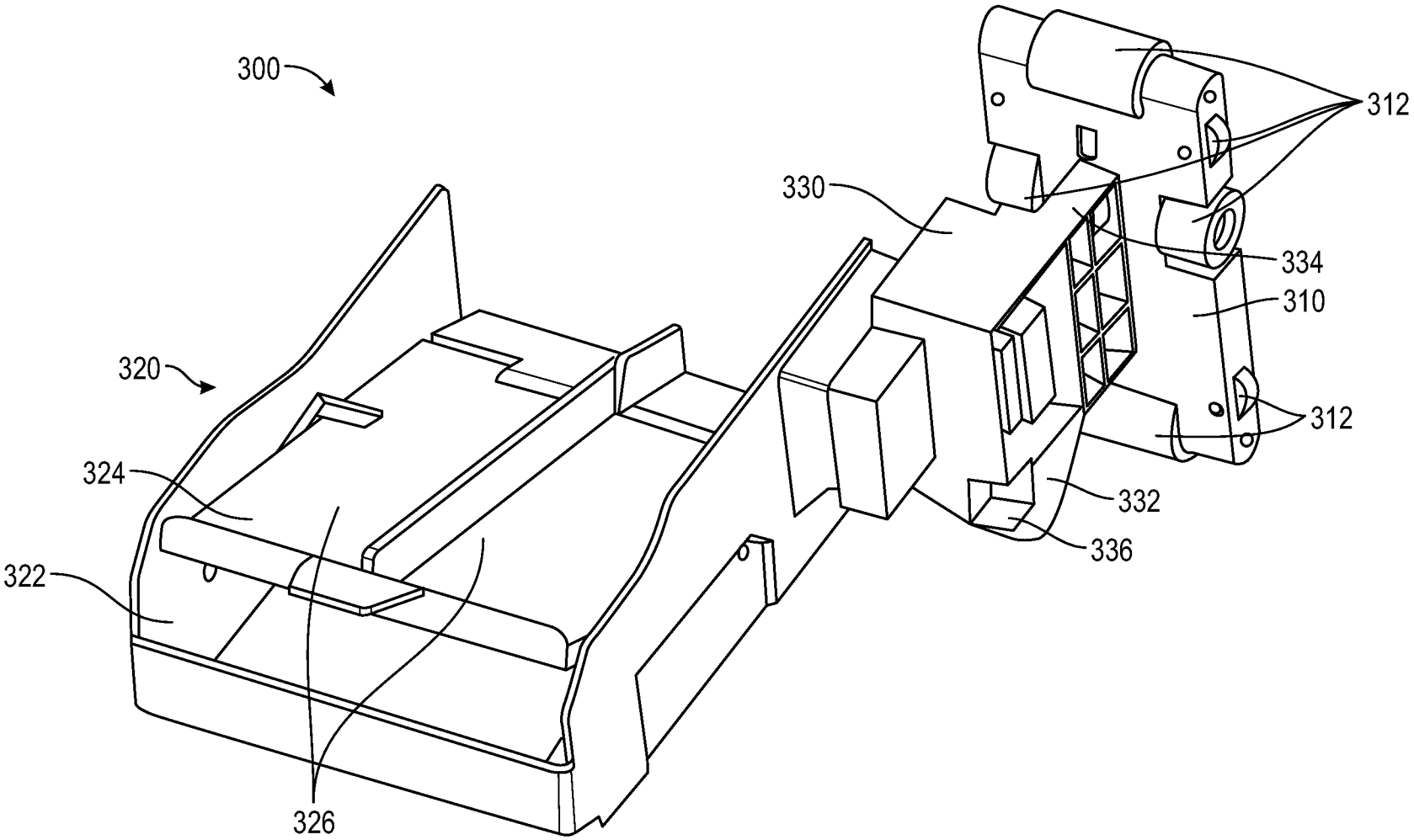
FIG. 5A illustrates a front perspective view of the elevator platform of the toy vehicle playset illustrated in FIG. 1A.
Figure 5B:
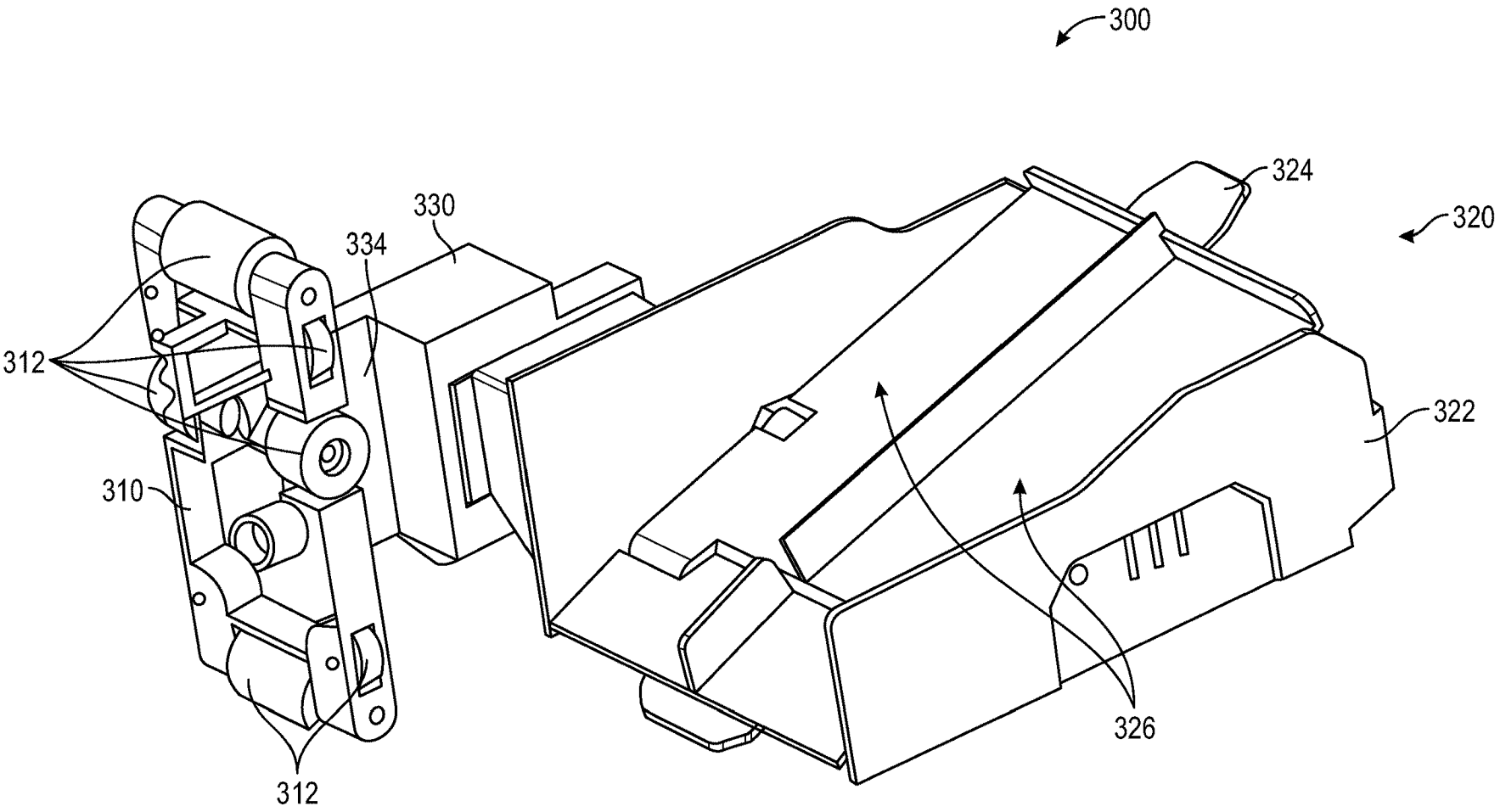
FIG. 5B illustrates a side perspective view of the elevator platform illustrated in FIG. 5A.

Turning to FIGS. 5A and 5B, illustrated are isolated views of the elevator device 300. The elevator device 300 includes a translation car 310, an elevator platform or movable platform 320, and a connection extension 330 that connects the translation car 310 and the elevator platform 320 to one another. The translation car 310 may be a substantially rectangular having a width sized to fit within the elevator track 240 on the rear side 208 of the first tower 200, as best illustrated in FIGS. 4B and 8. As best illustrated in FIGS. 5A and 5B, the translation car 310 includes a series of rollers 312 that enable the translation car 310 to travel along the elevator track 240 of the first tower 200. The elevator platform 320 of the elevator device 300 includes a frame portion 322 and a tiltable portion 324 disposed within the frame portion 322. In the embodiment illustrated, the tiltable portion 324 also includes two slots 326 configured to receive and/or retain toy vehicles. The tiltable portion 324 is configured to rotate or pivot with respect to the frame portion 322. The tiltable portion 324 may be tilted upwards in order to launch toy vehicles disposed in the slots 326 from the elevator platform 320. The connection extension 330 is connected to both the translation car 310 and the elevator platform 320. More specifically, the connection extension 330 is connected to the frame portion 322 of the elevator platform 320. The connection extension 330 includes a bottom side 332 and a recessed portion 334. The recessed portion 334 of the connection extension 330, as illustrated, is thinner in width than the remaining portions of the connection extension 330 such that the recessed portion 334 extends through the slot 246 of the elevator track path 240 when connected to the translation car 310 and the frame portion 322 of the connection extension 330. Moreover, the bottom side 332 of the connection extension 330 includes a slot 336.

Figure 6A:
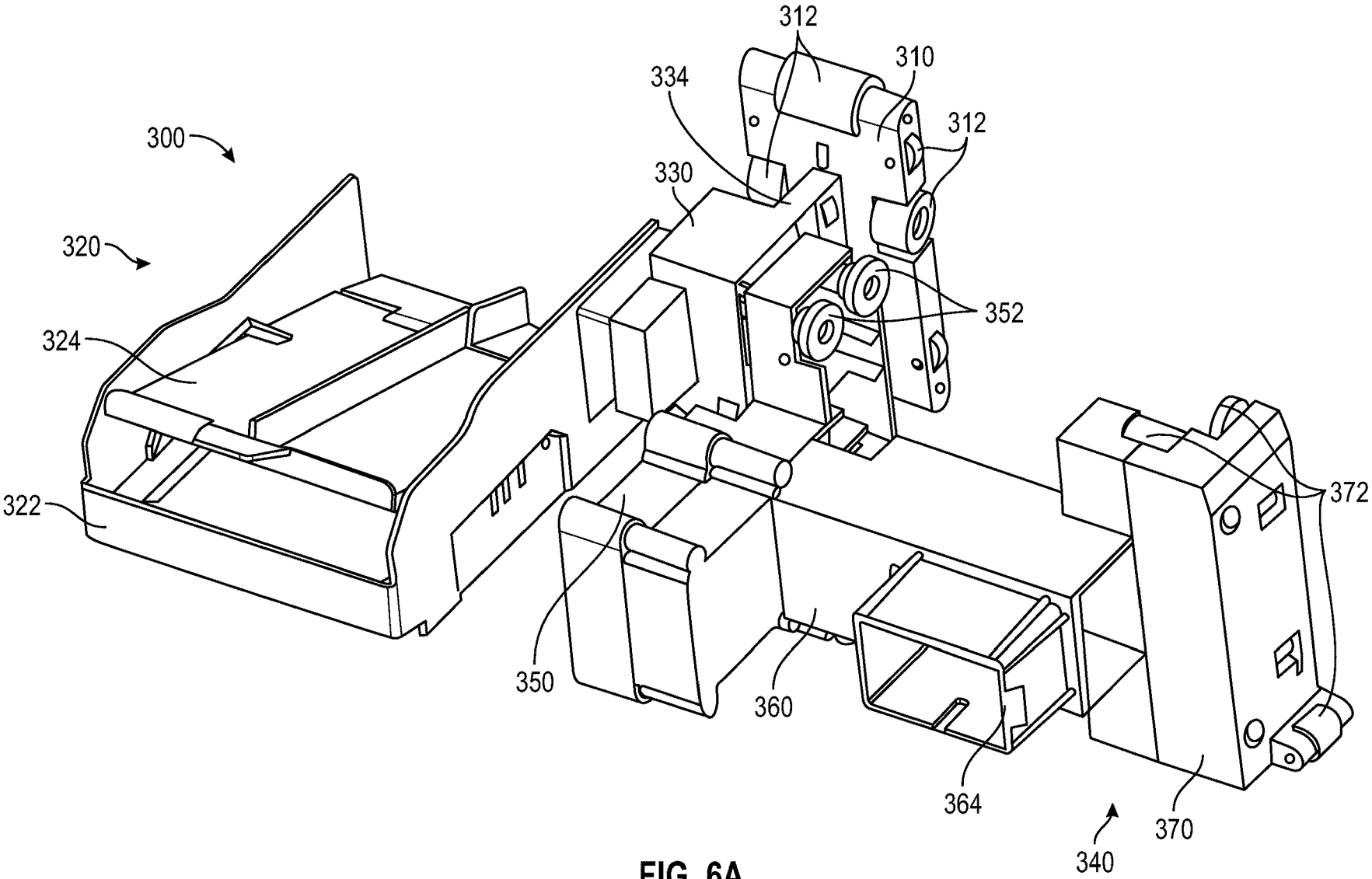
FIG. 6A illustrates a front perspective view of the elevator platform illustrated in FIG. 5A coupled to the interactive object track connector of the toy vehicle playset illustrated in FIG. 1A.
Figure 6B:
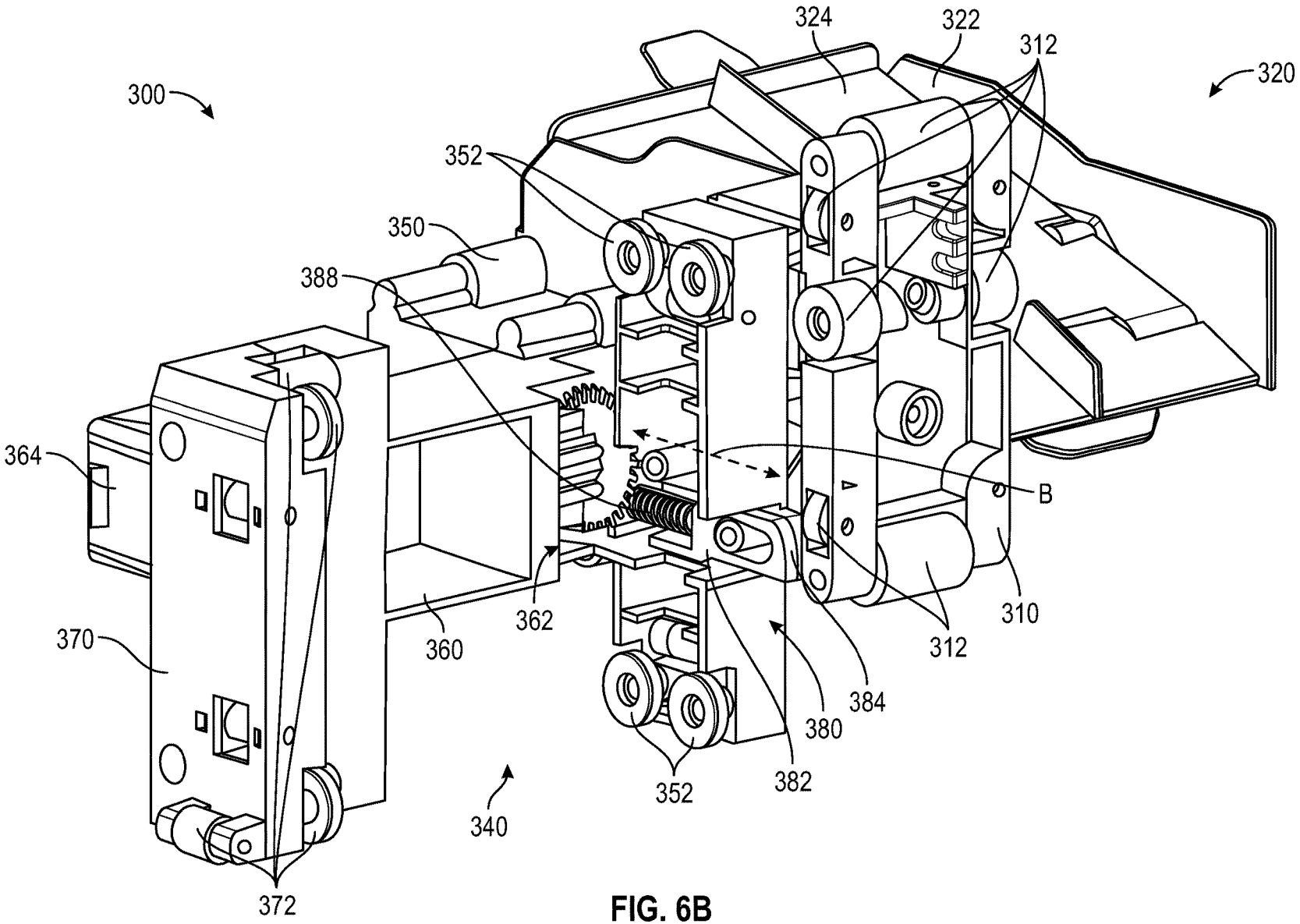
FIG. 6B illustrates a rear perspective view of the elevator platform and interactive object track connector illustrated in FIG. 6A.
Figure 6C:
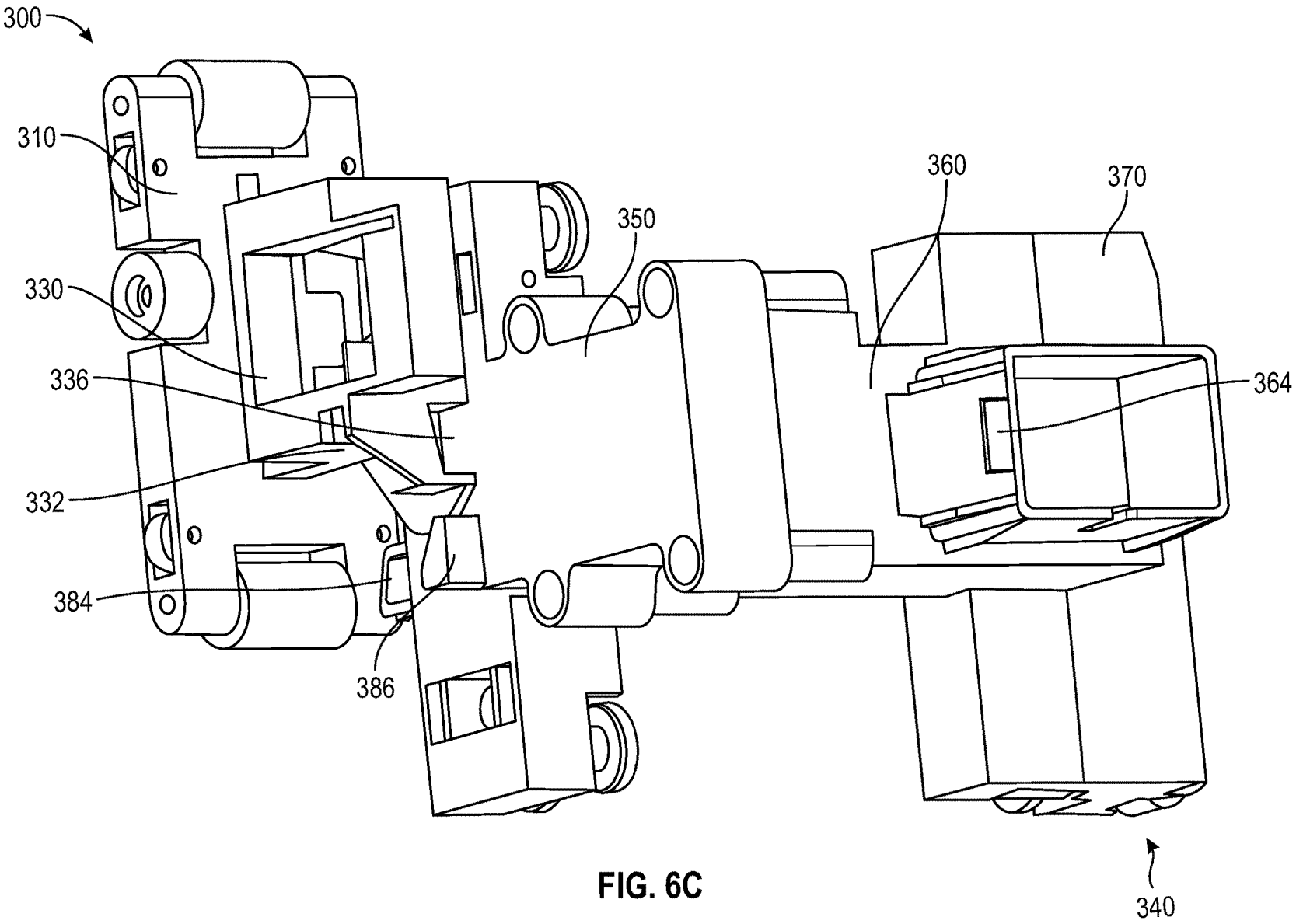
FIG. 6C illustrates a front view of the elevator platform and interactive object track connector illustrated in FIG. 6A, where a portion of the elevator platform is removed to show the lockout mechanism of the interactive object.

Turning to FIGS. 6A-6C, illustrated are isolated views of the elevator device 300 coupled to the interactive object track connector 340, also referred to herein as a bracket. The interactive object track connector 340 includes a first end member 350, an intermediate member 360, and a second end member 370. The first end member 350 is removably coupleable to the connection extension 330 of the elevator device 300 via a lockout mechanism 380, as explained in further detail below. The second end member 370 is affixed to the first end member 350 via the intermediate member 360. As illustrated, a portion of the first end member 350 includes a set of rollers 352. The attachment of the first end member 350 to the intermediate member 360 creates a housing for a set of gears 362 that are configured to at least partially intermesh with the gear teeth 216 of the linear rack 210. Further disposed on the intermediate member 360 are connection tabs 364 that are configured to facilitate attachment or connection of the interactive object 700 to the intermediate member 360. Similar to the first end member 350, a portion of the second end member 370 also includes a set of rollers 372.

As best illustrated in FIGS. 6B and 6C, the lockout mechanism 380 enables the interactive object track connector 340 to be removably coupled to the elevator device 300. The lockout mechanism 380 is disposed primarily in the first end member 350. The lockout mechanism 380 includes a tab 382 that contains a first engagement portion 384 (best illustrated in FIG. 6B) and a second engagement portion 386 (best illustrated in FIG. 6C). The first engagement portion 384 is configured to be engaged manually by a user when operating the lockout mechanism 380. The second engagement portion 386 may be configured to engage the slot 336 in the bottom 332 of the connection extension 330 of the elevator device 300 to removably couple the interactive object track connector 340 to the elevator device 300. When the second engagement portion 386 of the lockout mechanism 380 is disposed within the slot 336 of the connection extension 330 of the elevator device 300, the interactive object track connector 340 travels along the length of the first tower 200 as the elevator device 300 travels along plane A of the first tower 200. The lockout mechanism 380 is configured to translate along plane B between an engaged position (shown in FIGS. 6B and 6C) and a depressed position, where a resilient member 388 biases the tab 382 to the engaged position. When the lockout mechanism 380 is in the depressed position, the interactive object track connector 340, and thus the interactive object 700, is uncoupled from the elevator device 300.

Turning to FIGS. 7 and 8, illustrated are views of the first tower 200 that illustrate how the elevator device 300 and the interactive object track connector 340 operate with respect to the first tower 200 to translate along plane A between the top end 202 of the first tower 200 and the bottom end 204 of the first tower 200. As illustrated in FIG. 7, the rollers 352 of the first end member 350 of the interactive object track connector 340 are at least partially disposed within the first and second grooves 219*a*, 219*b* of linear rack 210, while at least one of the gears of the set of gears 362 is intermeshed with the gear teeth 216 of the linear rack 210. FIG. 7 further illustrates that some of the rollers 372 of the second end member 370 of the interactive object track connector 340 are configured to roll along the roller surface 226 of the linear guide track 220, while other rollers 372 of the second end member 370 are at least partially disposed within the groove 228 of the linear guide track 220. The rollers 352 of the first end member 350 of the interactive object track connector 340 being disposed within the grooves 219*a*, 219*b* of the linear rack 210, and the rollers 372 of the second end member 370 of the interactive object track connector 340 being disposed within the groove 228 of the linear guide track 220 secure the interactive object track connector 340 to the front side 206 of the first tower 200 while still enabling the interactive object track connector 340 to translate linearly along plane A from the top end 202 of the first tower 200 to the bottom end 204 of the first tower 200.

Figure 9A:
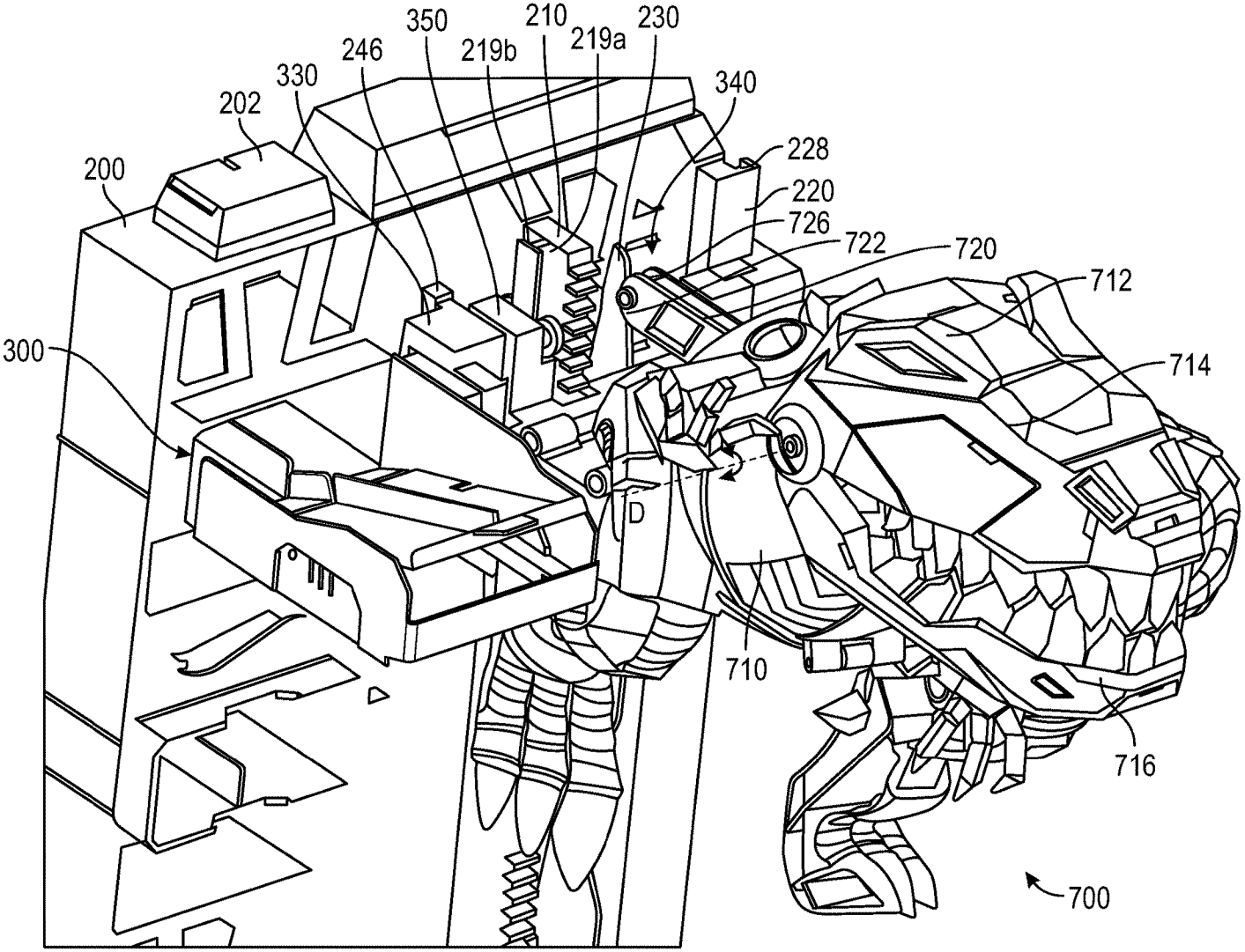
FIG. 9A illustrates a front perspective view of the interactive object of the toy vehicle playset illustrated in FIG. 1A, where the interactive object is coupled to the interactive object track connector and the elevator platform proximate to the top end of the first tower.

As illustrated in FIG. 8, the translation car 310 of the elevator device 300 is disposed within the elevator track 240 on the rear side 208 of the first tower 200. The rollers 312 of the translation car 310 of the elevator device 300 enable the translation car 310 to travel along the elevator track 240 between the first end 242 and the second end 244 of the elevator track 240. As previously explained the connection extension 330 of the elevator device 300 is coupled to the translation car 310 and the elevator platform 320 such that the recessed portion 334 of the connection extension 330 extends through the slot 246 of the elevator track 240 (as best illustrated in FIG. 9A). As further illustrated in FIG. 8, a pulley 248 is disposed proximate to the first end 242 of the elevator track 240. While not illustrated in FIGS. 4B and 8, a tether, string, cord, wire, or other elongated and flexible member may be coupled to the internal mechanism 254 of the crank mechanism 250 and the translation car 310, and at least partially wrapped around the pulley 248 to facilitate operation of the elevator device 300 by the crank mechanism 250. Thus, with the translation car 310, and subsequently, the elevator device 300, in the lowered position (i.e., proximate to the second end 244 of the elevator track 240 and the bottom end 204 of the first tower 200), rotation of the crank lever 252 simultaneously rotates the internal mechanism 254 to wrap the tether around the internal mechanism 254 and pull the translation car 310, and subsequently, the elevator device 300, upward along the elevator track 240. Conversely, when the translation car 310 and the elevator device 300 are in the raised position (i.e., proximate to the first end 242 of the elevator track 240 and the top end 202 of the first tower 200), the tether is unwrapped from the internal mechanism 254 to lower the translation car 310 and the elevator device 300.

Figure 9B:
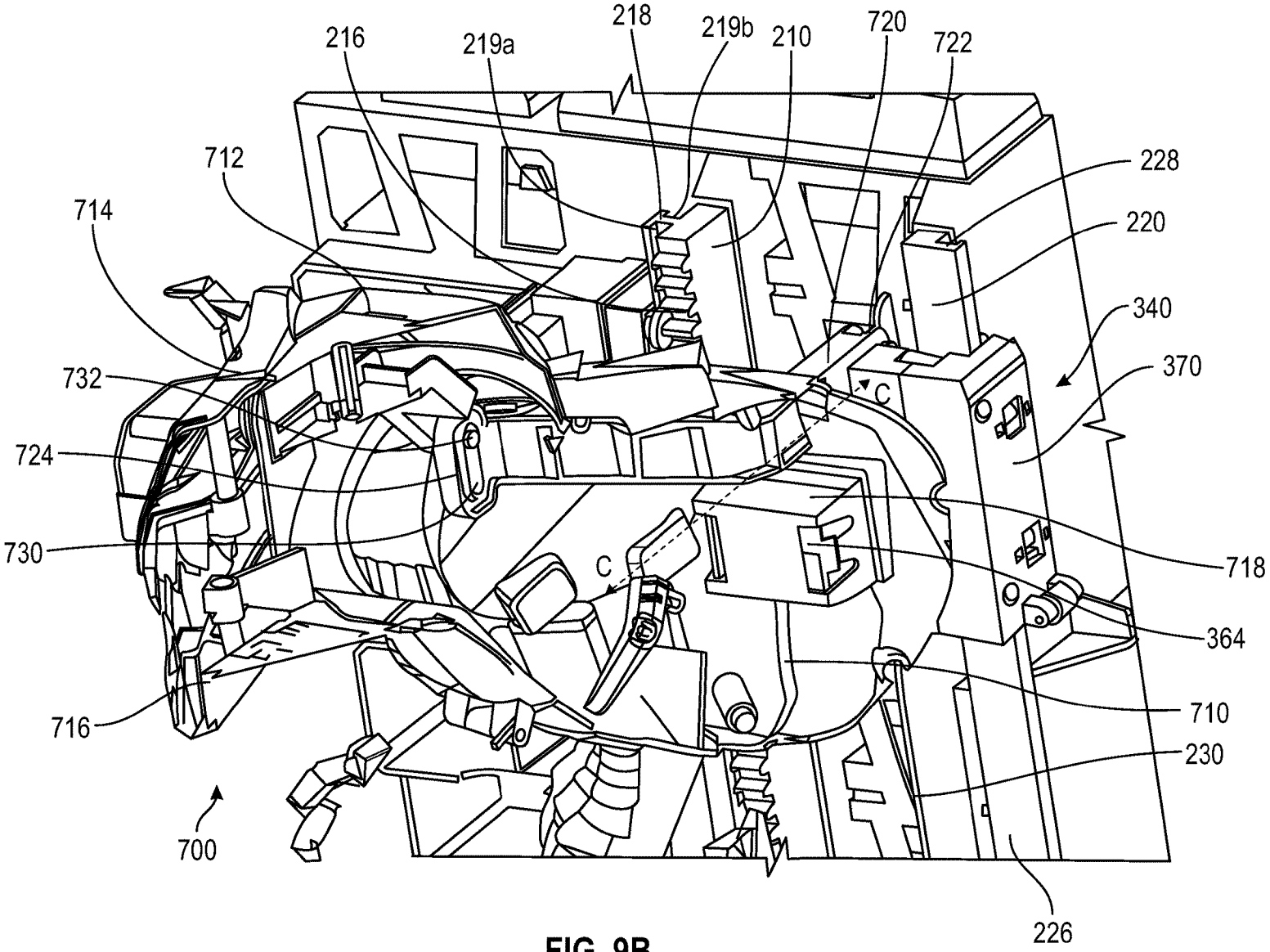
FIG. 9B illustrates a cross sectional view of the interactive object illustrated in FIG. 9A.

Turning to FIGS. 9A and 9B, illustrated are views of the interactive object 700 coupled to the interactive object track connector 340, and, ultimately, the elevator device 300. In the embodiment illustrated, the interactive object 700 resembles a dinosaur having a body 710 and a head 712. The head 712 may contain a first movable member or upper jaw member 714 and a second movable member or lower jaw member 716, where one or both of the movable members 714, 716 are movable with respect to the other and/or the body 710. The body 710 of the interactive object 700 may further contain a connection socket 718 that, as best illustrated in FIG. 9B, is configured to receive the connection tabs 364 to secure the interactive object 700 to the interactive object track connector 340.

As best illustrated in FIG. 9B, the interactive object 700 further includes an extended member 720 that extends at least partially into the body 710 of the interactive object 700. The extended member 720 includes a first end 722 and an opposite second end 724. The first end 722 may include a contact member or contact roller 726 that is configured to engage the interactive object track 230. The second end 724 of the extended member 720 may include an elongated slot 730, which, as illustrated, receives a pin 732 of the first movable member 714 of the head 712. In operation, as the interactive object 700 and the interactive object track connector 340 descend linearly along the linear rack 210 and the linear guide track 220 of the first tower 200, the contact member 726 of the extended member 720 rides along the interactive guide track 230 (i.e., rides along the extended and recessed portions 236, 238). When the contact member 726 of the extended member 720 is engaged with, or aligned with, one of the extended portions 236 of the interactive guide track 230, the extended portions 236 force the extended member 720 to translate into the body 710 of the interactive object 700 along plane C (i.e., pushes the extended member 720 further into the body 710 of the interactive object 700). This type of translation causes the second end 724 of the extended member 720, through the pin 732 being disposed within the slot 730, to rotate the first movable member 714 about axis D (best shown in FIG. 9A) to the opened position (i.e., opening the jaw). The first movable member 714 may contain a weight that is sufficient enough to maintain the contact member 726 in contact or abutment with the interactive guide track 230 as the interactive guide track 230 alternates between extended portions 236 and recessed portions 238. Thus, as the contact member 726 of the extended member 720 transitions from an extended portion 236 of the interactive guide track 230 to a recessed portion 238 of the interactive guide track 230, the extended member 720 translates in a direction that is out of the body 710 of the interactive object 700 along plane C (i.e., the weight of the first movable member 714 pushes the extended member 720 at least partially out of the body 710 of the interactive object 700). This type of translation causes the first movable member 714 to rotate about axis D to the closed position (i.e., closing the jaw). Because the interactive guide track 230 contains a series of extended portions 236 and recessed portions 238 that alternate with each other between the first end 232 and the second end 234 of the interactive guide track 230, as the interactive object 700 and the interactive object track connector 340 descend linearly along the first tower 200, the first movable member 714 of the interactive object continuously rotates between the opened position and the closed position. Thus, as the interactive object 700 linearly descends the first tower 200, the first movable member 714 performs a repeated movement (i.e., continuously rotates between the opened position and the closed position).

Figure 10A:
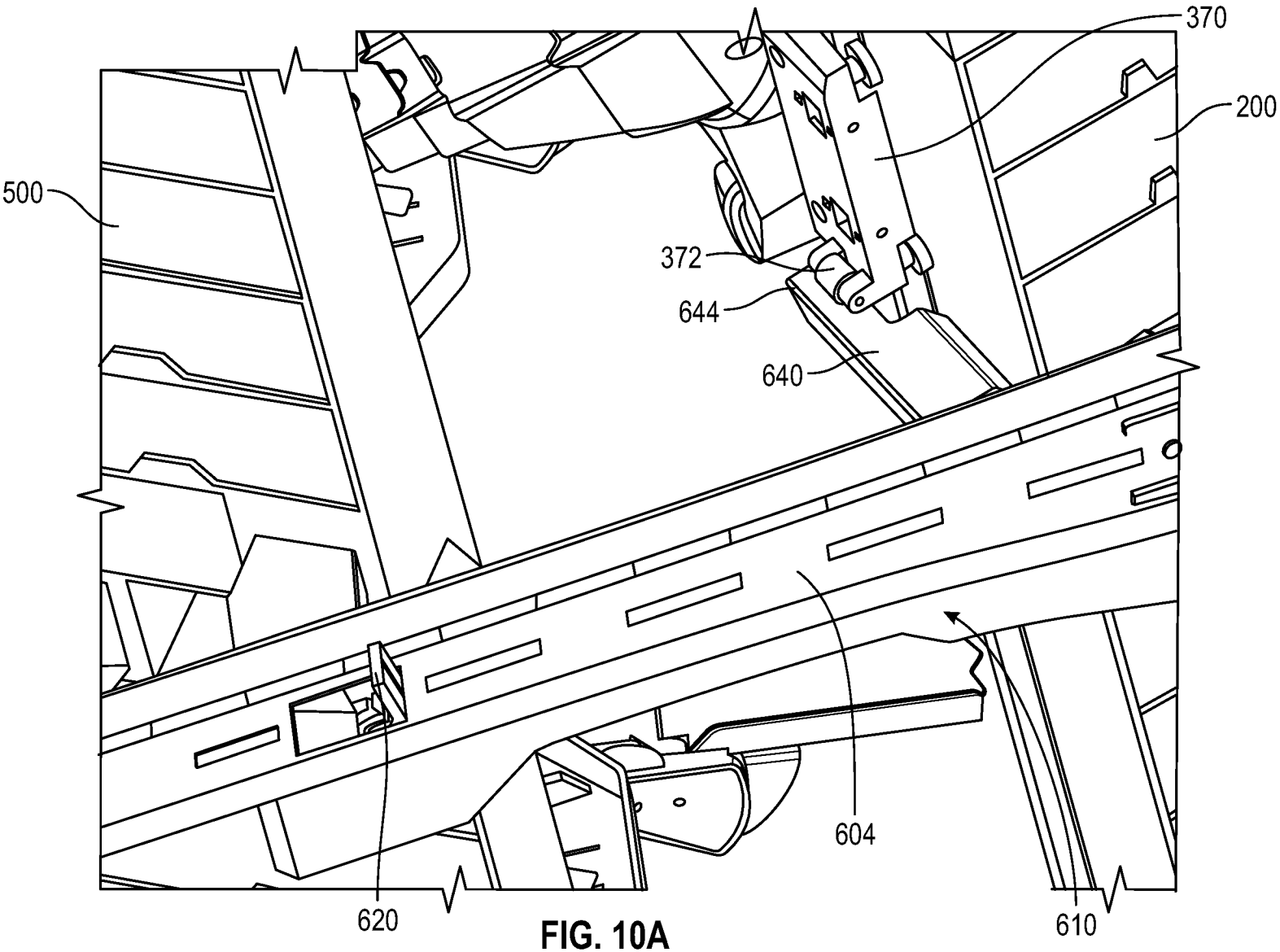
FIGS. 10A-10C illustrate a top perspective view (FIG. 10A), cross sectional view (FIG. 10B), and bottom perspective view (FIG. 10C) of the uppermost track section of the toy vehicle playset illustrated in FIG. 1A, and the mechanism coupled to the uppermost track section for triggering the interactive object of FIG. 9A to descend along the first tower illustrated in FIG. 4A.
Figure 10B:
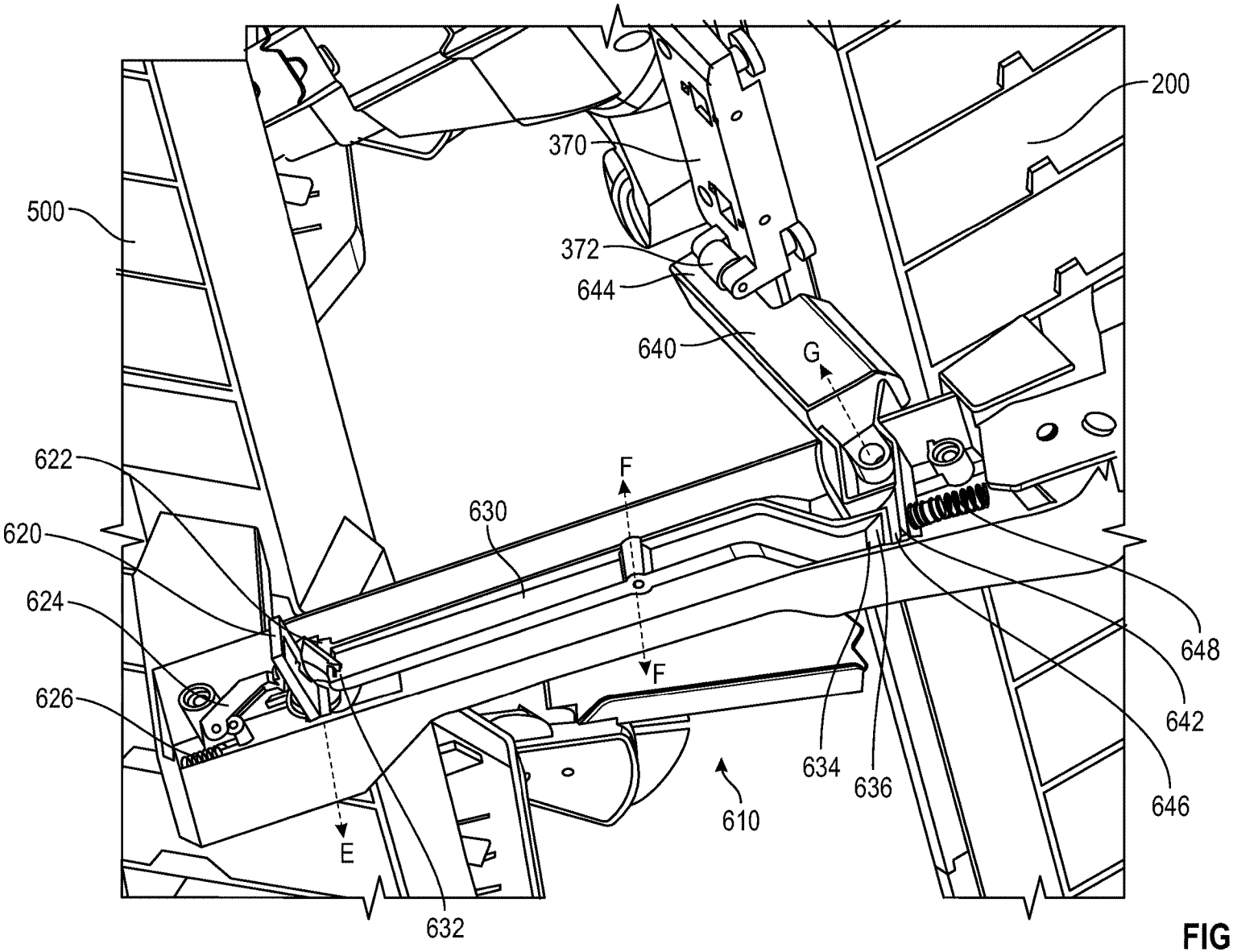
Figure 10C:
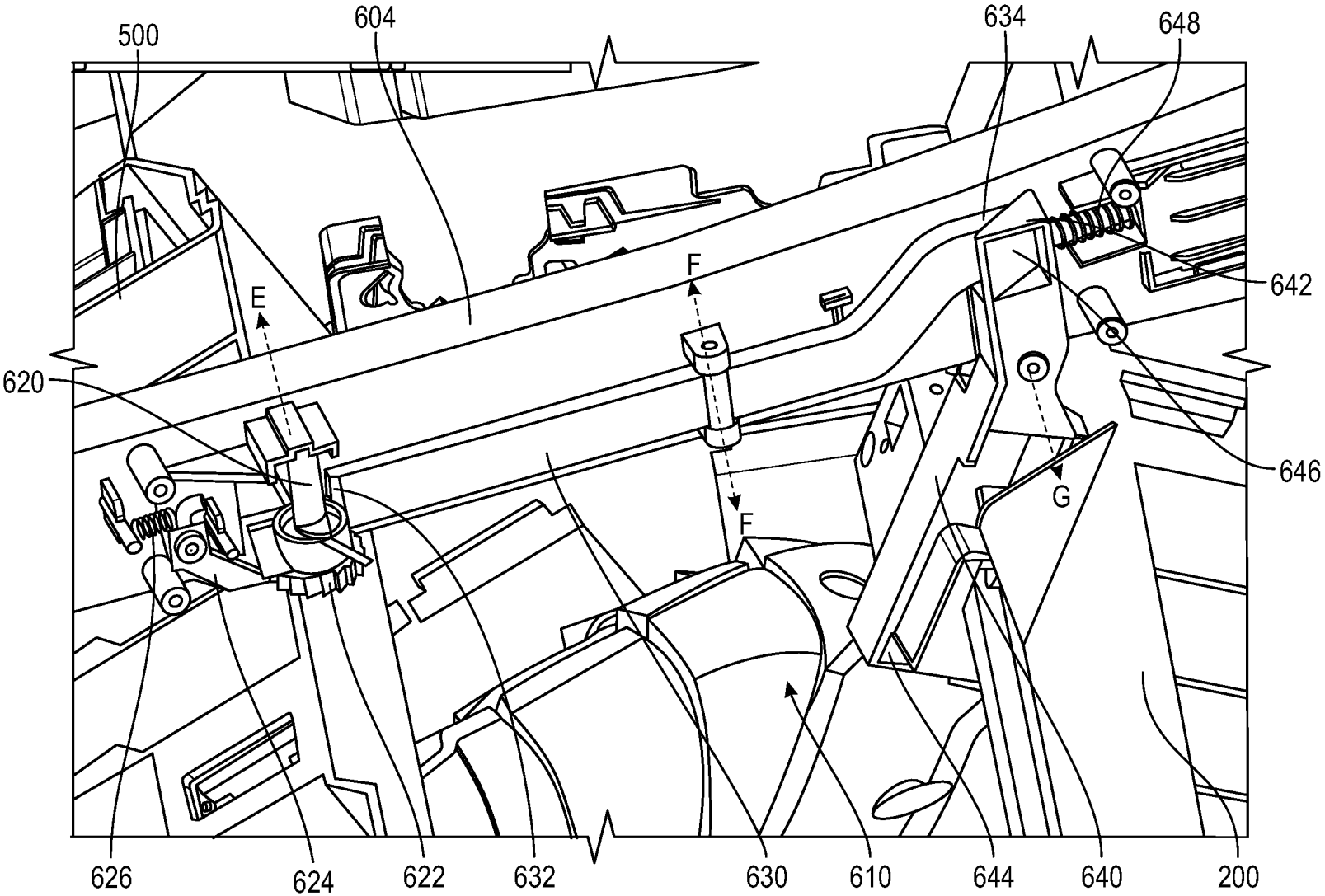

Turning to FIGS. 10A-10C, illustrated are various views of the uppermost track section 604 and the interactive object release mechanism 610, which is operatively coupled to the uppermost track section 604. The release mechanism 610 includes a trigger 620, an extension member 630, and a contact member 640. As best illustrated in FIG. 10A, the trigger 620 extends upwardly through the support surface of the uppermost track section 604 such that a toy vehicle traveling along the uppermost track section 604 may contact the trigger 620. As best illustrated in FIGS. 10B and 10C, the trigger 620 is coupled to a ratchet 622, which is in engagement with a pawl 624. The trigger 620 and ratchet 622 are configured to rotate about axis E, while the pawl 624 is biased into engagement with the ratchet 622 via a resilient member 626. As further illustrated in FIGS. 10B and 10C, the ratchet 622 is in further contact with the extension member 630. The extension member 630 is an elongated member that extends under the support surface of the uppermost track section 604, where the extension member 630 contains a first end 632 in contact with the ratchet 622 and an opposite second end 634 with a ramped portion 636. FIGS. 10B and 10C also illustrate that the contact member 640 contains a first end 642 and an opposite second end 644, where the first end 642 contains a mating ramped portion 646 and is biased into a position by a resilient member 648. More specifically, the ramped portion 636 of the extension member 630 is in abutment with the mating ramped portion 646 of the first end 642 of the contact member 640, while the second end 644 of the contact member 640 is in abutment with the bottom side of the second end member 370 and one of the rollers 372 of the second end member 370 of the interactive object track connector 340.

In operation, when a toy vehicle travels along the uppermost track section 604 and contacts the trigger 620, the toy vehicle forces the trigger 620 and the ratchet 622 to rotate about axis E. Because the first end 632 of the extension member 630 is in abutment with the ratchet 622, as the trigger 620 and the ratchet 622 are rotated about axis E, the extension member 630 is rotated about axis F, causing the ramped portion 636 of the second end 634 of the extension member 630 to abut and impart a force upon the mating ramped portion 646 of the first end 642 of the contact member 640. When the force imparted onto the mating ramped portion 646 of the first end 642 of the contact member 640 by the ramped portion 636 of the extension member 630 is enough to overcome the biasing force of the resilient member 648, the contact member 640 is rotated about vertical axis G. Once the second end 644 of the contact member 640 has rotated beyond the roller 372 of the second end member 370 of the interactive object track connector 340 (i.e., becomes spaced from the second end member 370 of the interactive object track connector 340), the interactive object track connector 340 and the interactive object 700 are free to descend the first tower 200 along the linear rack 210 and the linear guide track 220.

Figure 11:
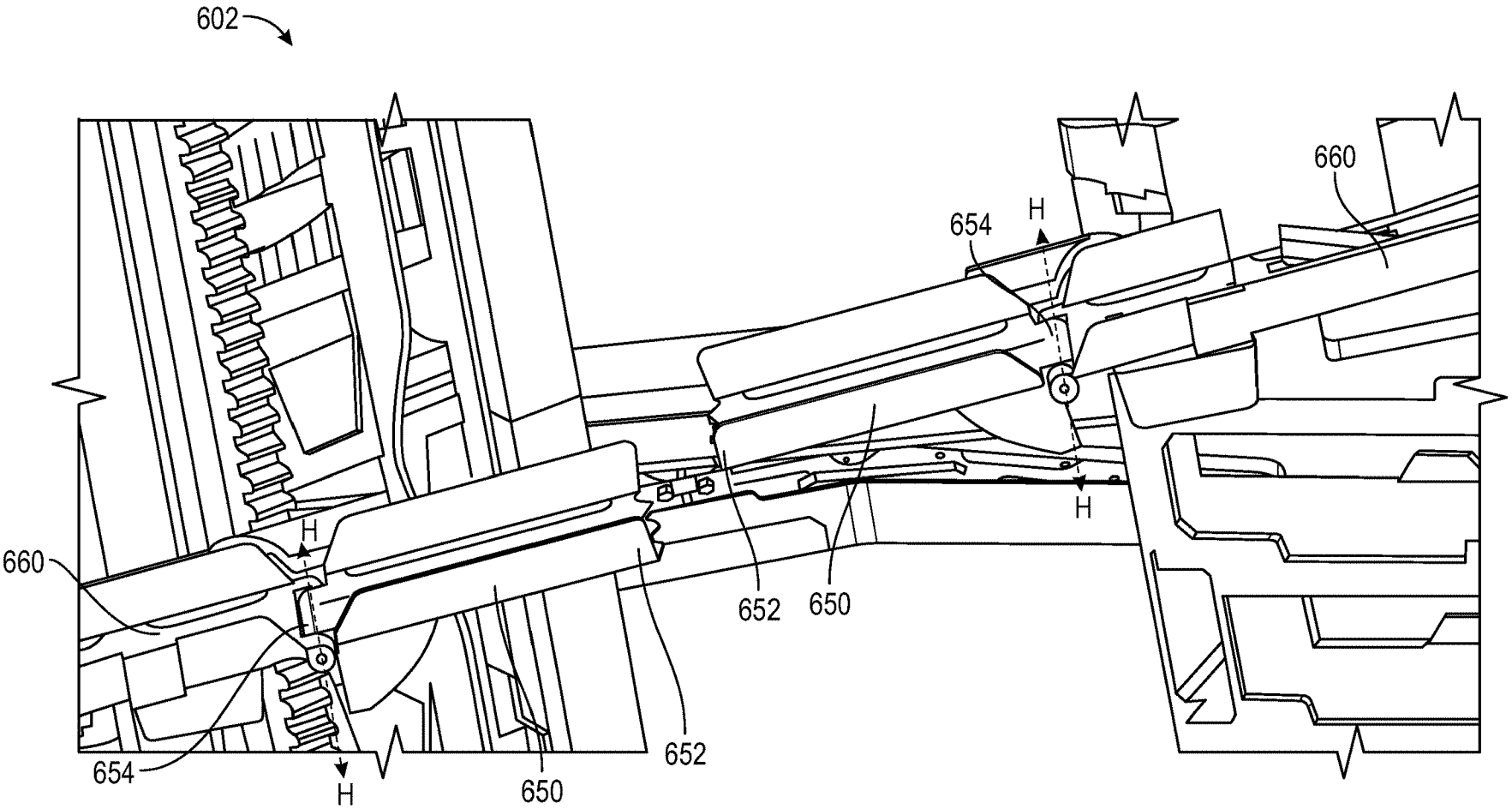
FIG. 11 illustrates a side view in elevation of the front track section of the toy vehicle playset illustrated in FIG. 1A, the front track section containing two rotational portions.

Turning to FIG. 11, illustrated is one embodiment of a front track section 602 in accordance with the present invention of the toy vehicle playset 10. The front track section 602 illustrated includes two rotatable track portion 650 that face one another and fixed track portions 660. Each rotatable track portion 650 includes a free end 652 and a rotatable end 654, where the rotatable end 654 is rotatably coupled to a fixed portion 660 of the front track section 602. The rotatable track portions 650 are configured to rotate about their rotatable ends 654 and axes H that extend through their rotatable ends 654. In some embodiments, the rotatable ends 654 of the rotatable track portions 650 may be biased to their horizontal positions by resilient members, which are not shown. As the interactive object 700 passes the front track sections 602, the head 712 of the interactive object 700 causes the rotatable track portion 650 to rotate about their axes H to enable the interactive component 700 to pass through the front track sections 602.

Turning to FIGS. 12A-12C, 13A, and 13B, illustrated are various views of one of the platforms 510 of the second tower 500. While the discussion of FIGS. 12A-12C, 13A, and 13B only describes one platform 510 of the second tower 500, the discussion applies to both platforms 510 of the second tower 500 illustrated in FIGS. 1A and 1B because both platforms 510 are substantially identical to one another.

As illustrated, the platform 510 includes a curved track portion 512 disposed around the outer periphery of the platform 510, a first ramp portion 514 that is disposed proximate to the curved track portion 512 and extends into the curved track portion 512, a platform storage portion 516 that is substantially horizontal and configured to store a plurality of toy vehicles thereon, and a second ramp portion 518 that is disposed proximate to the curved track portion 512 and the platform storage portion 516 and extends from the curved track portion 512 to the platform storage portion 516. The curved track portion 512 may be coupled to both one of the front track sections 602 and the uppermost rear track section 604 or the lower rear track sections 608 to promote and enable a toy vehicle traveling along the rear track sections 604, 608 to curve around the platform 510 onto the front track sections 602.

Figure 12A:
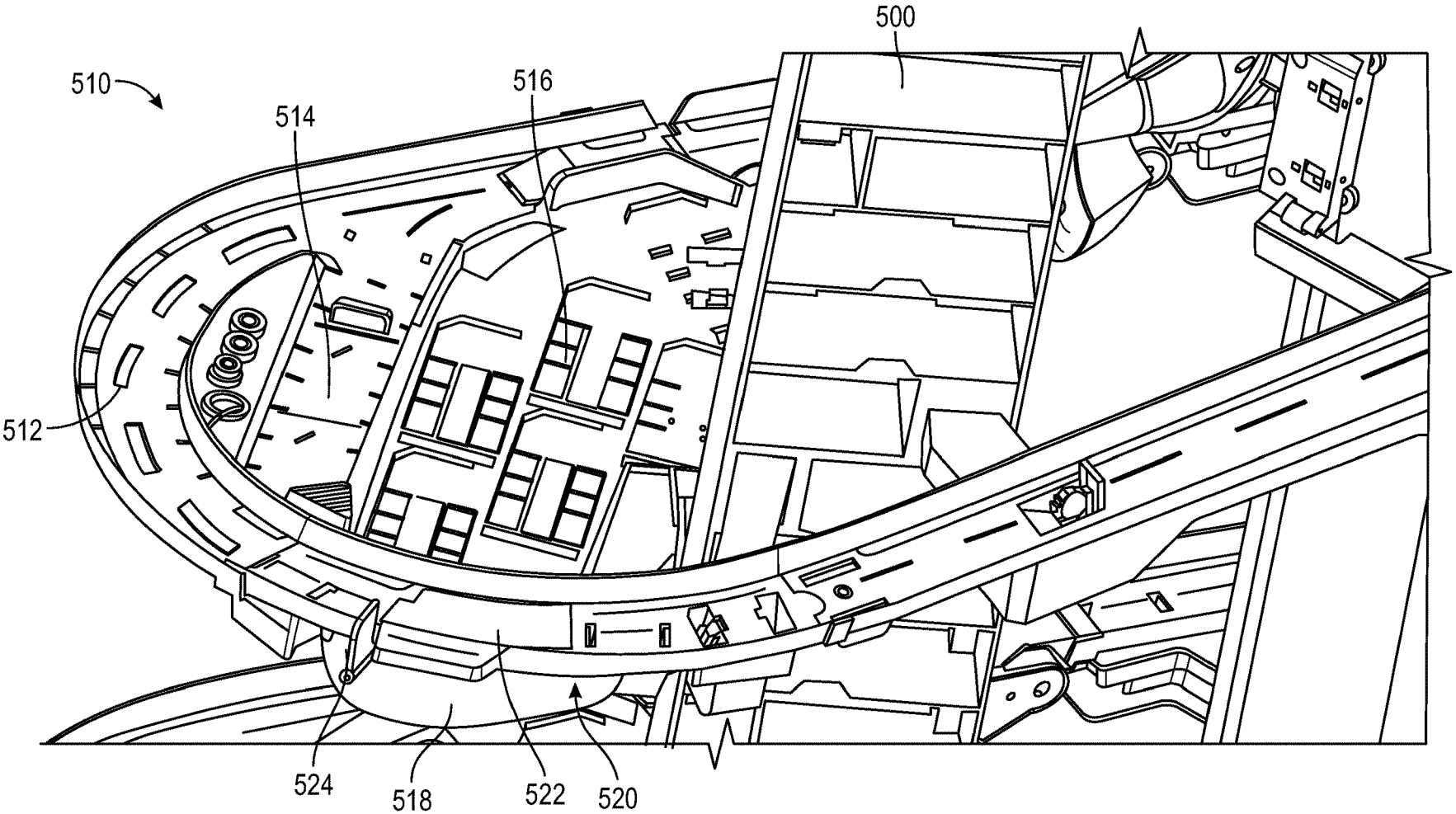
FIGS. 12A-12C illustrate a top perspective view (FIG. 12A), top view (FIG. 12B), and bottom perspective view (FIG. 12C) of one of the platforms coupled to the second tower of the toy vehicle playset illustrated in FIG. 1A, and, specifically, the mechanism capable of diverting a toy vehicle traveling along a track section onto the platform.
Figure 12B:
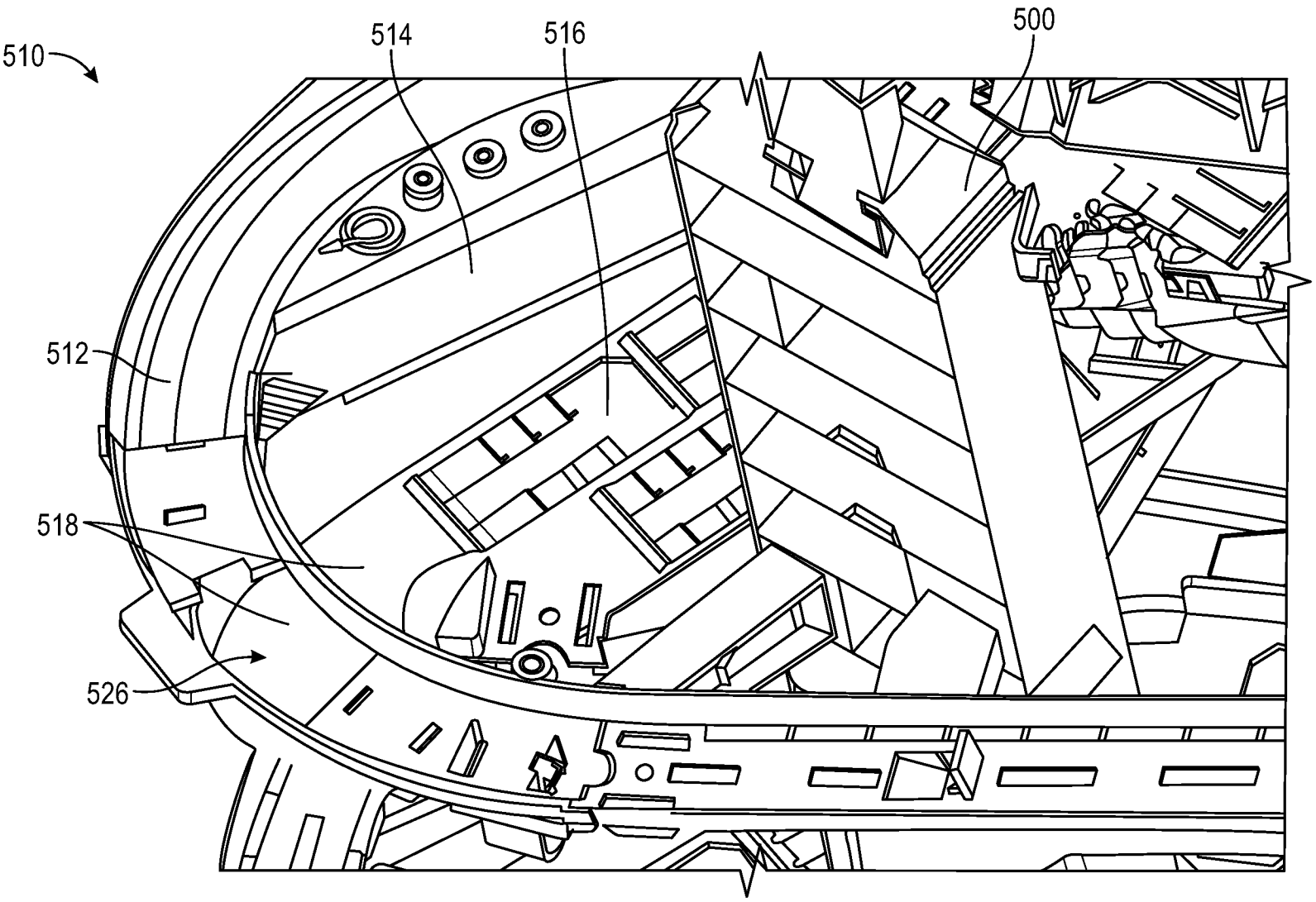
Figure 12C:
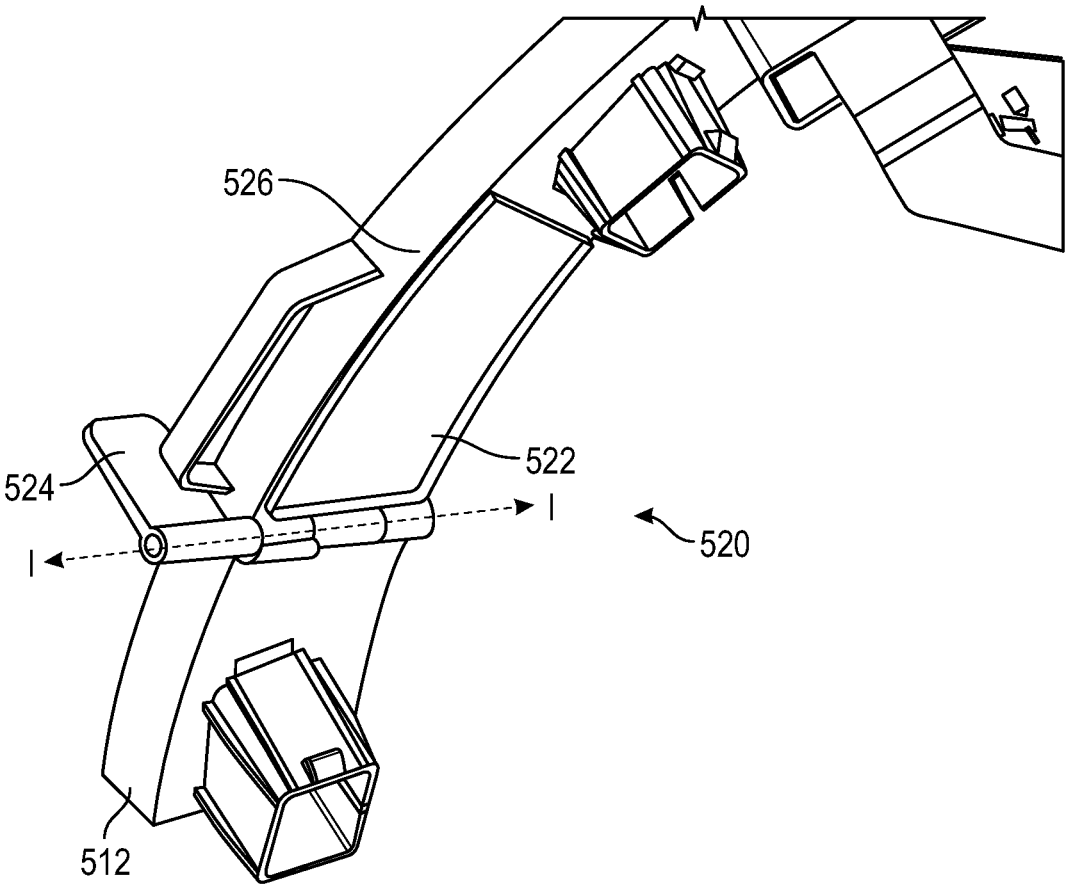

With specific regard to FIGS. 12A-12C, the curved track portion 512 includes a toy vehicle diverting mechanism 520. The diverting mechanism 520 is disposed at least partially within the support surface of curved track portion 512. The diverting mechanism 520 includes a door portion 522 and a lever portion 524 coupled to the door portion 522. The door portion 522 and the lever portion 524 are configured to rotate about axis I with respect to the platform 510 and the curved track portion 512 between a closed position, where the door portion 522 forms a section of the support surface of the curved track portion 512, and an opened position, where the door portion 522 is no longer aligned with, and disposed within, the support surface of the curved track portion 512. Moreover, when the door portion 522 is in the opened position, a passageway 526 is revealed in the support surface of the curved track portion 512. The passageway 526 is aligned with the second ramp portion 518 of the platform 510 such that, when a toy vehicle is traveling along the curved track portion 512 and the diverting mechanism 520 is in the opened position, the toy vehicle travels through the passageway 526, down the second ramp portion 518, and onto the platform storage portion 516 of the platform 510. Conversely, when a toy vehicle is traveling along the curved track portion 512 and the diverting mechanism 520 is in the closed position, the toy vehicle travels over the door portion 522 of the diverting mechanism 520 and continues to travel along the curved track portion 512 to the front track section 604.

Figure 13A:
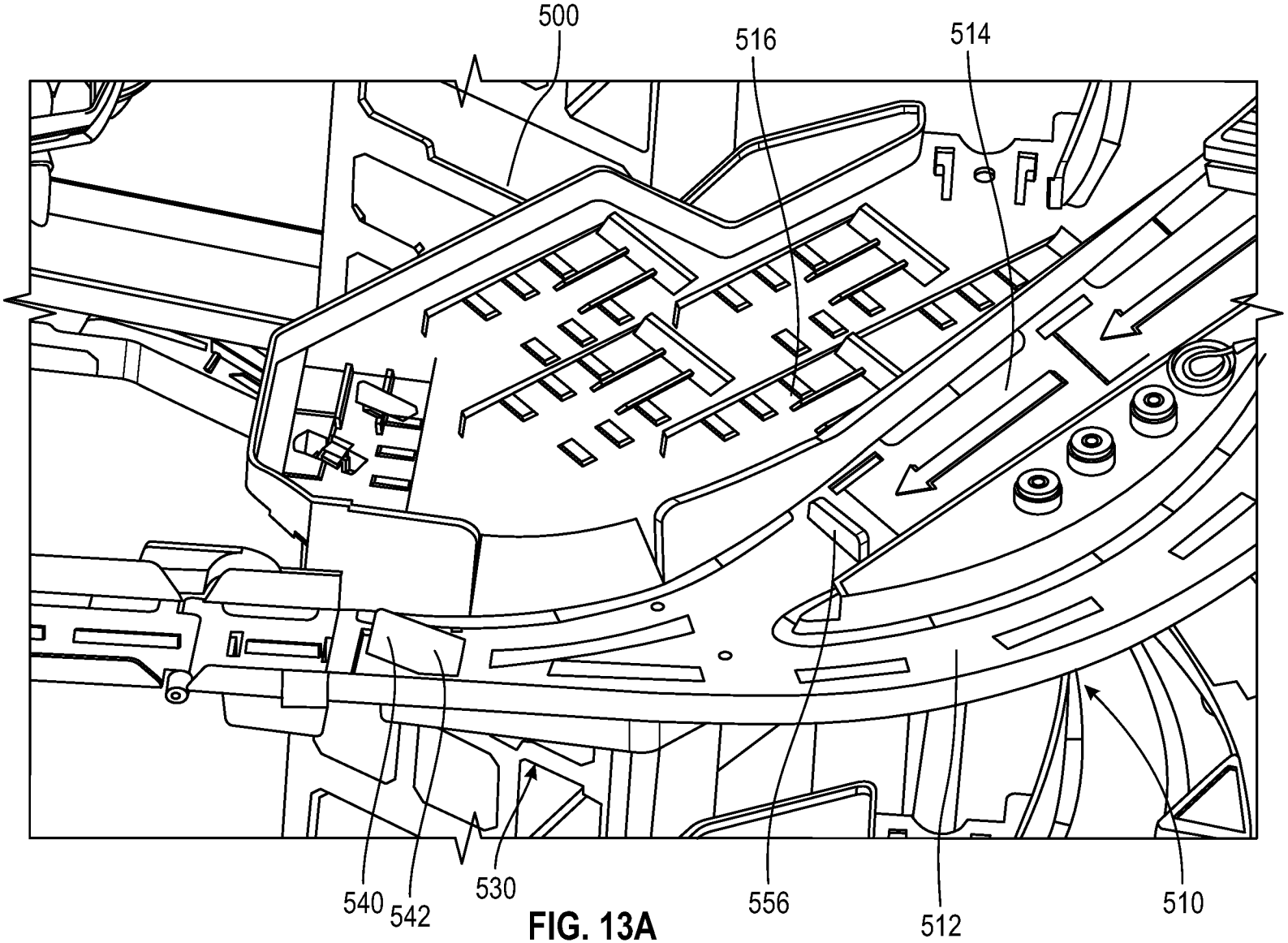
FIGS. 13A and 13B illustrate a top perspective view (FIG. 13A) and bottom perspective view (FIG. 13B) of one of the platforms coupled to the second tower of the toy vehicle playset illustrated in FIG. 1A, and, specifically, the mechanism capable of launching a toy vehicle onto a track section from the platform.
Figure 13B:
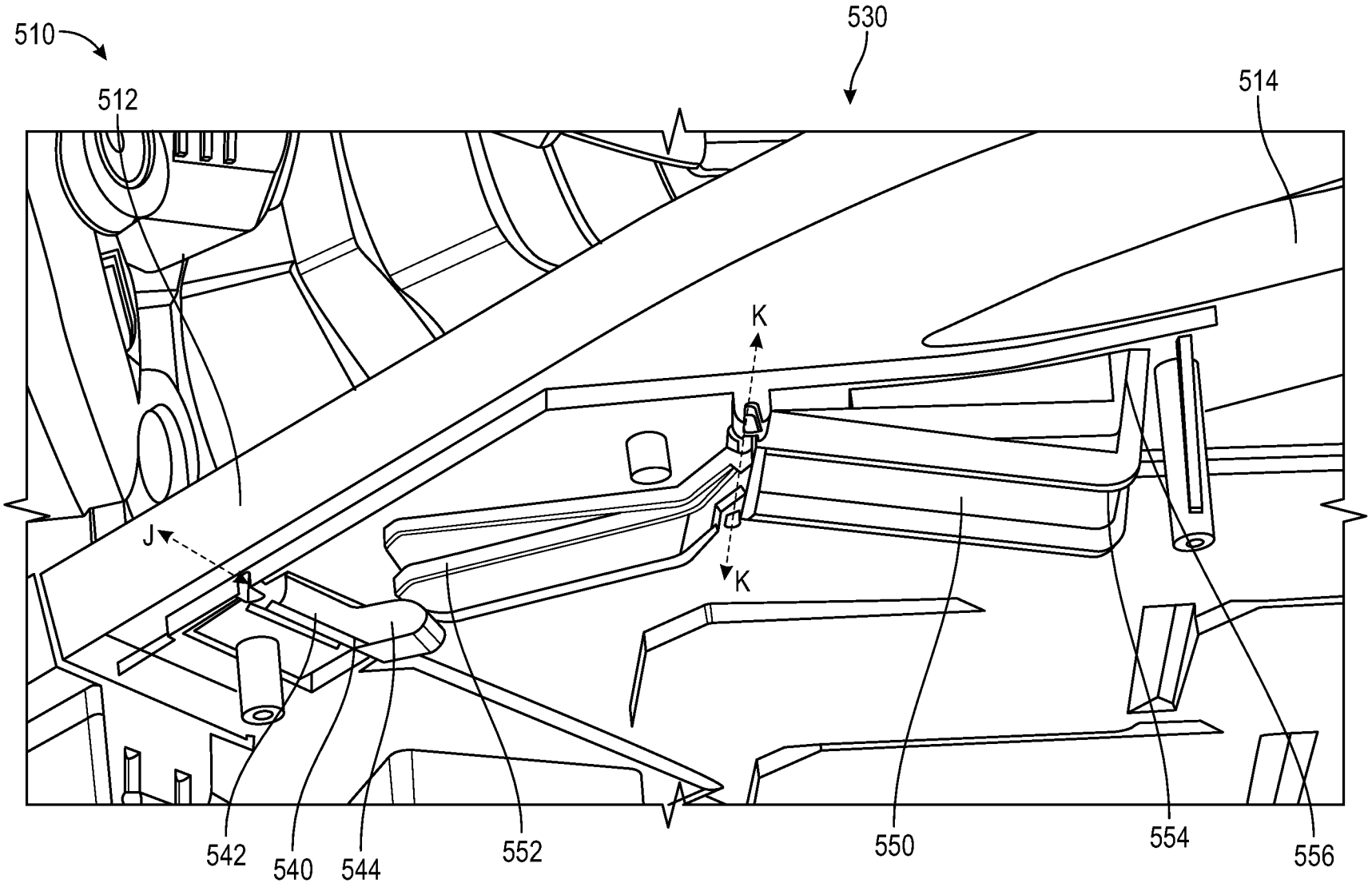

With specific regard to FIGS. 13A and 13B, illustrated are various views of a toy vehicle launching mechanism 530 of the platform 510, where the toy vehicle launching mechanism 530 triggers one or more additional toy vehicles to be added to or launched onto the track sections 600 to descend to the base 100. The launching mechanism 530 includes a trigger member 540 and an extension member 550. The trigger member 540 includes a first portion 542 that extends through the support surface of the curved track 512 of the platform 510 and a second portion 544 that is disposed below the support surface of the curved track 512 of the platform 510. The trigger member 540 is configured to rotate about axis J which extends through the first portion 542 of the trigger member 540. The extension member 550 includes a first end 552 and an opposite second end 554, and is configured to rotate about an axis K that extends through the extension member 550 at a location intermediate the first and second ends 552, 554. As best illustrated in FIG. 13B, the first end 552 of the extension member 550 is disposed proximate to the second portion 544 of the trigger member 540 of the launching mechanism 530. The first end 552 is disposed below the curved track portion 512 and may be in abutment with the second portion 544 of the trigger member 540. The second end 554 of the extension member 550 may be disposed below the first ramp portion 514, and may include an upwardly extending tab 556 that, as best illustrated in FIG. 13A, extends upwardly through the first ramp portion 514 of the platform 510.

In operation, one or more toy vehicles may be disposed in a line on the first ramp portion 514 such that the front end of a toy vehicle first in the line is in abutment with the tab 556 of the extension member 550, which prevents the toy vehicle (and any other toy vehicles behind it) from traveling down the first ramp portion 514 onto the curved track 512. At the same time, the first portion 542 of the trigger member 540 extends through the curved track portion 512 at a location just beyond where the first ramped portion 514 intersects the curved track portion 512. When a toy vehicle travels along the curved track portion 512 and impacts the first portion 542 of the trigger member 540, the impact causes the trigger member 540 to rotate about axis J, which causes the second portion 544 to impact the first end 552 of the extension member 550, and to force the first end 552 of the extension member 550 upwards towards the bottom side of the curved track portion 512. Forcing the first end 552 of the extension member 550 upwards causes the extension member 550 to rotate about axis K, which forces the second end 554 to move away from the bottom side of the first ramp portion 514. This, in turn, causes the tab 556 to translate downwardly through the support surface of the first ramp portion 514. Once the tab 556 no longer extends through the support surface of the first ramp portion 514, the one or more toy vehicles disposed on the first ramp portion 514 are free to travel along the first ramp portion 514 onto the curved track portion 512, and eventually descend the toy vehicle playset 10 along the track sections 600 to the base 100.

When a user operates the toy vehicle playset 10 in a first play pattern (i.e., with the functions of the interactive object 700), the user may push one or more toy vehicles along the base 100, up the ramp 112 of the base 100, and onto the elevator platform 320 of the elevator device 300. The user may then operate the crank mechanism 250 via the crank lever 252 to raise the elevator device 300 (i.e., such that the elevator device 300 linearly ascends the first tower 200), and subsequently the toy vehicles disposed on the elevator device 300 to one of the passageways 400 in the first tower 200. If the user does not operate the lockout mechanism 380 of the interactive object track connector 340 prior to raising the elevator device 300, the interactive object 700 will also rise along the first tower 200 with the elevator device 300 (i.e., the interactive object 700 will also linearly ascend the first tower 200). If the user stops the elevator device 300 at one of the first two passageways 400, the toy vehicles may be launched from the elevator device 300 onto one of the platforms 420, 430 of the first tower 200. The user may also operate the crank mechanism 250 until the elevator devices 300 reaches the uppermost passageway 400 of the first tower 200, where the toy vehicles are launched from the elevator device 300 to race along the track sections 600 of the playset 10. As the toy vehicles travel along the uppermost track section 604, the first toy vehicle may trigger the interactive object release mechanism 610, which causes the interactive object 700, which is a dinosaur in the embodiment illustrated, to descend linearly along the first tower 200. The set of gears 362 of the interactive object track connector 340 being intermeshed with the gear teeth 216 of the linear rack 210 cause the interactive object 700 to be lowered with a speed such that the interactive object reaches the rotatable track portions 650 of the front track section 602 at approximately the same time as the toy vehicles that were launched from elevator device. Furthermore, as previously explained, the interaction of the extended member 720 with the extended and recessed portions 236, 238 of the interactive guide track 230 cause the interactive object 700 to repeatedly open and close the upper jaw member 714 as the interactive object 700 descends the first tower 200 along path A. This cumulatively gives the appearance that the interactive object 700 is attempting to eat the toy vehicles as they descend along the track sections 600, and specifically as they pass by the front track sections 602.

When a user operates the toy vehicle playset 10 in a second play pattern (i.e., without the functions of the interactive object 700), the user may operate the lockout mechanism 380 such that the second engagement portion 386 is not disposed within the slot 336 of the connection extension 330 of the elevator device 300 as the user operates the crank mechanism 250 via the crank lever 252 to raise the elevator device 300 and the toy vehicles disposed on the elevator device 300. Because the second engagement portion 386 of the lockout mechanism 380 is not disposed within the slot 336 of the connection extension 330 of the elevator device 300 while the elevator device 300 is being raised, the interactive object 700 does not rise along the first tower 200 with the elevator device 300. This enables the toy vehicles to be launched from the elevator device 300 at the fully raised position and race along the track sections 600 without being impeded or affected by the interactive object 700. When the elevator device 300 is fully lowered, the second engagement portion 386 of the lockout mechanism 380 is able to reengage with the slot 336 of the connection extension 330 of the elevator device 300. This allows the user to resume operation of the toy vehicle playset 10 in the first or second play pattern as desired.

In both play patterns, and as previously explained above, the use may operate the diverting mechanism 520 to divert one or both of the launched toy vehicles onto the platforms 510 as the toy vehicles travel along the track sections 600. Also during both play patterns, if one or more toy vehicles are disposed on the first ramp portions 514 of the platforms 510, the launched toy vehicles will trigger the actuation of the launching mechanism 530, as previously explained above, to add additional vehicles onto the track sections 600 which then descend the toy vehicle playset 10 together.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle playset comprising:

a base;

a tower extending upwardly from the base;

a track disposed about the tower, the track configured to enable a toy vehicle to descend the tower along the track; and an interactive object movably coupled to the tower such that the interactive object is configured to linearly ascend and descend the tower, wherein the interactive object is triggered by the toy vehicle descending the tower via the track to descend the tower simultaneous to the toy vehicle, the interactive object being configured to attempt to impact the toy vehicle traveling along the track.

2. The toy vehicle playset of claim 1, wherein the track helically extends around the tower.

3. The toy vehicle playset of claim 2, wherein the track includes a front track disposed proximate to a front side of the tower.

4. The toy vehicle playset of claim 3, wherein the front side of the tower includes a linear rack.

5. The toy vehicle playset of claim 4, wherein the interactive object is movably coupled to the front side of the tower and includes a set of gears configured to intermesh with the linear rack.

6. The toy vehicle playset of claim 5, wherein, when the toy vehicle begins to descend from a top end of the tower along the track simultaneous to the interactive object linearly descending from the top end of the tower, the set of gears cause the interactive object to linearly descend with a speed such that the interactive object reaches the front track at approximately a time the toy vehicle travels along the front track.

7. The toy vehicle playset of claim 6, wherein the interactive object includes a movable member that is configured to perform a repeated movement as the interactive object linearly descends the tower.

8. A toy vehicle playset comprising:

a base;

a tower extending upwardly from the base;

a series of track sections that collectively define a path for a toy vehicle to descend the tower; and an interactive object movably coupled to the tower such that the interactive object is configured to linearly ascend and descend the tower, wherein, when the interactive object travels linearly along the tower, the interactive object intersects through a portion of a track section of the series of track sections, the portion of the track section being located between a first end and a second end of the track section.

9. The toy vehicle playset of claim 8, wherein the track section further includes a rotatable track portion.

10. The toy vehicle playset of claim 9, wherein, when the interactive object travels linearly along the tower, the interactive object causes the rotatable track portion to rotate as the interactive object passes through the track section.

11. The toy vehicle playset of claim 8, further comprising:

a movable platform movably coupled to the tower such that the movable platform is configured to linearly ascend and descend the tower; and a crank mechanism operatively coupled to the movable platform, wherein rotation of the crank mechanism causes the movable platform to linearly ascend the tower.

12. The toy vehicle playset of claim 11, wherein the interactive object further includes a lockout mechanism that is repositionable between a first position, where the lockout mechanism couples the interactive object to the movable platform, and a second position, where the interactive object is uncoupled from the movable platform.

13. The toy vehicle playset of claim 12, wherein, when the lockout mechanism is in the first position and when the movable platform and the interactive object are disposed proximate to a bottom end of the tower, rotation of the crank mechanism causes the movable platform and the interactive object to linearly ascend the tower toward a top end of the tower.

14. The toy vehicle playset of claim 13, wherein, when the lockout mechanism is in the second position and when the movable platform and the interactive object are disposed proximate to the bottom end of the tower, rotation of the crank mechanism causes the movable platform to linearly ascend the tower toward the top end of the tower while the interactive object remains disposed proximate to the bottom end of the tower.

15. A toy vehicle playset comprising:

a base;

a tower extending upwardly from the base, the tower including a top end and a bottom end;

a track disposed about the tower and including an actuator operatively coupled to a portion of the track, the track configured to enable a toy vehicle to descend the tower along the track, wherein the toy vehicle traveling along the portion of the track actuates the actuator; and an interactive object movably coupled to the tower such that the interactive object is configured to linearly ascend and descend the tower, the interactive object including a movable member, wherein actuation of the actuator by the toy vehicle traveling along the track when the interactive object is positioned proximate the top end of the tower releases the interactive object to descend linearly along the tower, and wherein the movable member of the interactive object performs a repeated movement as the interactive object descends linearly along the tower.

16. The toy vehicle playset of claim 15, wherein the actuator includes a trigger member and a contact member operatively coupled to the trigger member, the trigger member extending through the portion of the track and configured to rotate about a horizontal axis with respect to the portion of the track, wherein rotation of the trigger member causes the contact member to rotate about a vertical axis from a first position to a second position.

17. The toy vehicle playset of claim 16, wherein the interactive object is movably coupled to the tower via a bracket.

18. The toy vehicle playset of claim 17, wherein, when the interactive object is positioned proximate the top end of the tower and the actuator is unactuated, the contact member is in the first position where the contact member is in abutment with the bracket, which retains the interactive object proximate to the top end of the tower.

19. The toy vehicle playset of claim 18, wherein, when the toy vehicle travels along the portion of the track and actuates the actuator, the toy vehicle impacts and rotates the trigger member about the horizontal axis.

20. The toy vehicle playset of claim 19, wherein rotation of the contact member about the vertical axis from the first position to the second position causes the contact member to become spaced from the bracket of the interactive object, which releases the interactive object to linearly descend along the tower.

* * * * *